US006378342B1

(12) United States Patent
Fukumoto et al.

(10) Patent No.: US 6,378,342 B1
(45) Date of Patent: Apr. 30, 2002

(54) ELECTRIC WASHER-DRYER

(75) Inventors: Masami Fukumoto, Ikeda; Junichi Morinaka, Otsu; Yasushi Takagi, Osaka; Shinichi Matsuda, Suita, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/852,277

(22) Filed: May 10, 2001

Related U.S. Application Data

(62) Division of application No. 09/266,599, filed on Mar. 11, 1999, now Pat. No. 6,282,928.

(30) Foreign Application Priority Data

| | | |
|---|---|---|
| Mar. 12, 1998 | (JP) | 10-060874 |
| Jun. 5, 1998 | (JP) | 10-157283 |
| Jun. 5, 1998 | (JP) | 10-157284 |
| Oct. 6, 1998 | (JP) | 10-283695 |
| Feb. 4, 1999 | (JP) | 11-27549 |
| Feb. 4, 1999 | (JP) | 11-27555 |

(51) Int. Cl.[7] ..... D06F 25/00; D06F 39/08
(52) U.S. Cl. ..... 68/20; 68/207
(58) Field of Search ..... 68/19.2, 20, 207

(56) References Cited

U.S. PATENT DOCUMENTS

| | | | | |
|---|---|---|---|---|
| 2,737,799 A | * | 3/1956 | Brucken | 68/20 |
| 2,782,622 A | | 2/1957 | Candor | |
| 2,818,719 A | | 1/1958 | Cline | |
| 2,863,311 A | | 12/1958 | Brucken | |
| 3,323,336 A | | 6/1967 | Johnson et al. | |
| 3,401,052 A | | 9/1968 | Berger et al. | |
| 4,204,339 A | | 5/1980 | Muller | |
| 4,303,406 A | * | 12/1981 | Ross | 68/207 X |
| 5,293,761 A | * | 3/1994 | Jang | 68/207 X |
| 5,537,761 A | | 7/1996 | Oh | |
| 5,714,939 A | * | 2/1998 | Song | 68/207 X |

FOREIGN PATENT DOCUMENTS

| | | |
|---|---|---|
| EP | 0 501 747 | 9/1992 |
| EP | 0 704 569 | 4/1996 |
| GB | 2215826 | 9/1989 |
| JP | 9-774 | 1/1997 |
| WO | 94/10370 | 5/1994 |

OTHER PUBLICATIONS

Patent Abstracts of Japan, vol. 014, No. 299 (C–0733), Jun. 27, 1990 & JP 02 098396 A (Sanyo Electric Co. Ltd.), Apr. 10, 1990 * abstract; figures *.

* cited by examiner

*Primary Examiner*—Philip Coe
(74) *Attorney, Agent, or Firm*—Wenderoth, Lind & Ponack, L.L.P.

(57) ABSTRACT

A washer-dryer has an improved efficiency of drying; namely, the drying time is shortened and the unevenness of drying is alleviated. Furthermore, vibration during operations, especially during spin-drying, is reduced. An inner tub of approximately cylindrical shape rotating around a substantially vertical axis and for receiving a wash load is housed in an outer tub. The inner tub is provided with freely rotatable agitating means at the bottom part for agitating the wash load. A motor rotates the inner tub or the agitating means. The air to be supplied through a hot air supply channel into the inner tub is heated by heating means, which air is advanced by a drying air blower into the inner tub. Control means controls each of the washing, rinsing, spin-drying and drying processes by controlling respective operations of the motor, the heating means, the drying air blower, etc. During the drying process, a wash load is agitated by the agitating means, and exposed to the air heated by the heating means and blown by the drying air blower against the washing staying within the inner tub. The washing is thus removed of humidity and dried.

14 Claims, 20 Drawing Sheets

PRIOR ART

ELECTRIC WASHER-DRYER

This is a divisional application of parent application Ser. No. 09/266,599 filed on Mar. 11, 1999, and now U.S. Pat. No. 6,282,928.

FIELD OF THE INVENTION

The present invention relates to a washer-dryer that treats a wash load, which has been thrown into an inner tub disposed rotatably inside an outer tub of the washer-dryer, through a whole process beginning from washing to drying.

BACKGROUND OF THE INVENTION

A conventional washer-dryer having the above-described functions has been structured as illustrated in FIG. 20. The structure is described below.

Referring to FIG. 20, an inner tub 1 of approximately cylindrical shape, functioning as a tub for both washing and spin-drying operations, is provided rotatably within the inside of an outer tub 2. At the upper part of inner tub 1 is a fluid balancer 3, in the inner bottom is a provided a pulsator 4 that is freely rotatable. The outer tub 2 is housed in a cabinet 6, being suspended by a suspension gear 5 for anti-vibration. A motor 7 is provided at the bottom part of the outer tub 2. The motor 7 has a built-in clutch and gear for conveying the revolving force of the motor to a wash/spin-dry shaft 8, which has an empty dual-shaft structure and switches the transmission to the pulsator 4 or to the inner tub 1 in accordance with a process, washing or spin-drying. The outer tub 2 is connected at the bottom to a drain channel 9 via a drain cock 10. Hot air blowing means 11 comprises an air-blower and a heater (neither is shown); which is attached on the outer tub 2 for supplying hot air inside the inner tub 1 for drying the wash load.

The operation of a washer-dryer of the above structure is described below. In a washing process, a wash load 12 is thrown into the inner tub 1 together with detergent, and water or hot water is supplied therein. The clutch built in the motor 7 is switched to convey the driving force of the motor 7 to the pulsator 4 via a wash shaft. The wash load 12 is stirred by rotation of the pulsator 4.

In a spin-drying process, which follows after the washing process is over, water in the inner tub 1 is discharged by opening the discharge cock 10, and the clutch built in the motor 7 is switched to convey the driving force of the motor 7 to the inner tub 1 via a spin-dry shaft. The inner tub 1 is rotated, and the wash load 12 is provided with a centrifugal force and is spin-dried.

In a drying process, hot air is supplied to inside the inner tub 1 by the hot air blowing means 11 while the pulsator 4 is driven in a normal mode. The wash load 12 is dried by the hot air.

However, in the drying process under the conventional structure as described above, the hot air supplied from the hot air blowing means 11 into the inner tub 1 does not reach to the whole space of inner tub 1; the bottom space, among others, is not provided with a sufficient amount of hot air. Therefore, it is difficult to provide a wash load 12 with a sufficient amount of the heat and the velocity of hot air in an efficient manner. This means that it takes a long time for drying, and that a wash load may not be dried evenly. Furthermore, as the hot air blowing means 11 has been attached on the outer tub 2, the gross weight of the vibrating body formed of the outer tub 2 and the hot air blowing means 11, which have been suspended by the suspension gear 5 from the cabinet 6, is a substantial amount; which results in significant vibration during operation, especially during the spin-drying process.

SUMMARY OF THE INVENTION

The present invention addresses the above-described problems, and intends to raise the efficiency of drying performance by reducing the drying time and improving the unevenness of drying. Also intended in the present invention is to alleviate the vibration during operations, especially during the spin-drying process.

An invented washer-dryer comprises an inner tub of approximately cylindrical shape rotating around a substantially vertical axis for receiving a wash load, the inner tub being housed in an outer tub, agitation means disposed rotatably in the inner tub for agitating a wash load, a motor for rotating the inner tub or the agitation means, heating means for heating the air to be supplied through a hot air supply channel into the inner tub, a drying air blower for delivering hot air into the inner tub, and control means for controlling each of the washing, rinsing, spin-drying and drying processes by controlling the operations of the motor, heating means, drying air blower, etc. During the drying process, a wash load is agitated by the agitation means and the air heated by the heating means is blown by the drying air blower against the wash load staying within the inner tub. By so doing, the wash load may be dehydrated and dried within a short period of time, without leaving significant unevenness of drying. Thus, the efficiency of drying is improved. Also, the vibration is substantially alleviated during operation, especially during the spin-drying process.

More desirably, the coupling of a hot air supply channel and an outer tub should be made by using a flexible and expandable tube. With such a structure, even if the inner tub rotating at a high speed generates an oscillating vibration during the spin-drying process, the outer tub may not be jerked in one specific horizontal direction by the hot air supply channel, so it can continue making a natural vibration. Vibration of outer tub caused by the high-speed rotation of inner tub is conveyed evenly to a cabinet. Therefore, the vibration as a whole is suppressed.

Desirably also, the upper part of outer tub should be covered with a separation board for preventing the air from escaping; and a water supply cock for supplying water into the inner tub is connected to an intake of water provided in the separation board by using a water supply duct in order to facilitate the water supply into the inner tub. With such a structure, the hot air is prevented from escaping during the drying process. Thus the drying performance is improved. At the same time, the increase of humidity in the room air due to escaping hot air is avoided.

DESCRIPTION OF THE PREFERRED EMBODIMENTS

Figure 1:
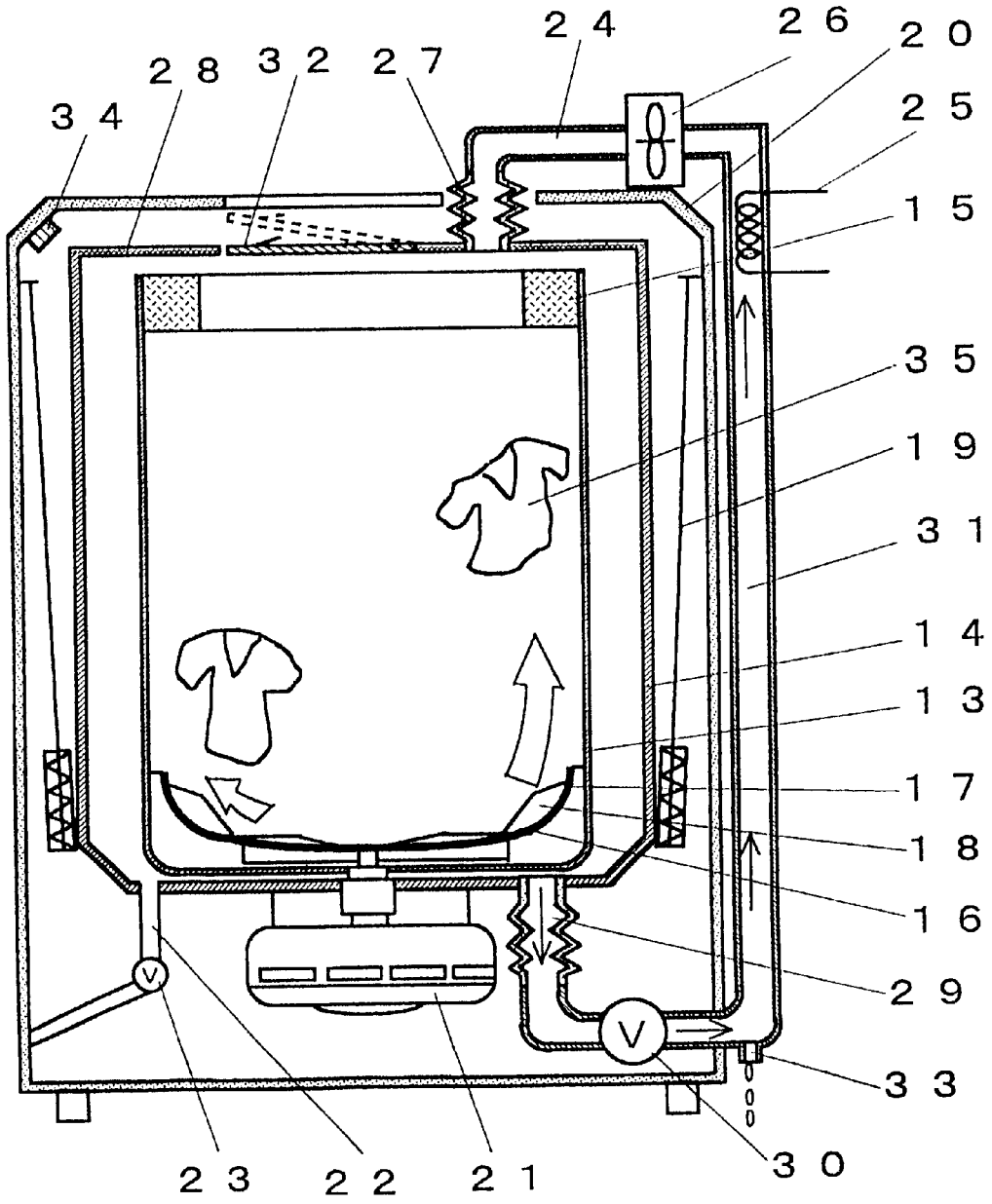
FIG. 1 is a vertical cross sectional view of a washer-dryer in accordance with a first exemplary embodiment of the present invention.

A first exemplary embodiment of the present invention is described with reference to FIG. 1.

An inner tub 13 forms a tub for both washing and spin-drying operations. It has an approximately cylindrical shape with a number of small holes (not shown) in the sidewall, rotates around an approximately vertical axis, and is housed inside an outer tub 14. At the upper part of inner tub 13 is a fluid balancer 15, and a bowl shape pulsator (agitation means) 16 is provided freely rotatable at the inner bottom. The pulsator 16 has a slope region 17 in the outer portion, and is provided with a plurality of ribs 18 extending in radial directions across the slope region 17 almost as far as the outer edge. The outer tub 14 is housed in a cabinet 20 being suspended by a suspension gear 19, for preventing vibration. A motor 21 is provided at the bottom of the outer tub 14. The motor 21 has a built-in clutch and gear for switching the transmission of rotating force of the motor 21 to a wash shaft or to a spin-dry shaft in order to rotate the pulsator 16 or the inner tub 13 depending on the process, washing or spin-drying. The outer tub 14 is connected at the bottom to a water discharge channel 22 via a water discharge valve 23.

A hot air supply channel 24, which is to supply hot air to the inside of inner tub 13 during drying process, comprises a heater (heating means) 25 for heating the air and a drying air blower 26 for delivering hot air into the inner tub 13. The hot air supply channel 24 is fixed to the cabinet 20, and is connected to a separation board 28 provided on the upper part of the outer tub 14 by means of a flexible and expandable tube 27 of bellows shape. The outer tub 14 is provided at the bottom with a connection duct 29 for returning the hot air. The connection duct 29 is coupled with a heat exchanger 31 via a water discharge-switching valve 30, and is coupled further with the hot air supply channel 24 containing the heater 25 and the drying air blower 26, and finally with the outer tub 14 via the flexible and expandable tube 27. The separation board 28 is provided with a freely openable lid 32. The separation board 28 is fixed on the outer tub 14 covering the upper end in order to prevent the hot air from escaping upward. The freely openable lid 32 is for throwing in and removing a wash load. A closed circulation channel is thus formed by the connection duct 29, the heat exchanger 31, the hot air supply channel 24, etc. The flexible and expandable tube 27 and the connection duct 29 connect the cabinet 20 (fixed end) and the outer tub 14 (vibrating end) in a flexible manner, The heat exchanger 31 is disposed outside of the cabinet 20 so as to ensure the heat exchange by means of air-cooling. A drain hole 33 is provided at the bottom of the heat exchanger 31. Control means or controller 34 controls each of the washing, rinsing and spin-drying processes through control of the operation of the motor 21, the water discharge valve 23, a water supply tap (not shown), etc. The control means 34 also controls the drying process through the control of the operation of the motor 21, the heater 25, the drying air blower 26, etc. During the drying process, a wash load 35 is agitated by the pulsator 16 and is blown by the hot air heated by the heater 25 and delivered by the drying air blower 26 into the inner tub 13. The heat exchanger 31 dehydrates the air for drying. The control means 34 also controls the rotation speed of pulsator 16 so that it rotates at a higher speed during the washing process than during the drying process.

The operation of the above structure is described below. In the washing process through the spin-drying process, a wash load 35 is put into the inner tub 13 through the freely openable lid 32 together with detergent. Starting the operation, water is supplied from a water tap into the inner tub 13 up to a certain level, and then the pulsator 16 is rotated to initiate a washing process. After the washing process is finished, the same procedures are repeated for rinsing. By closing the water discharge-switching valve 30, the water in the outer tub 14 is prevented from escaping through the drain hole 33. A spin-drying process begins with opening of the water discharge valve 23, and the inner tub 13 is rotated at a high speed. The wash load is spin-dried through an ordinary procedure, and then it proceeds to a drying process.

In the drying process, the water discharge valve 23 is closed, whereas the water discharge-switching valve 30 is opened. Hot air created by the heat generation of the heater 25 is delivered into the inner tub 13 by the operation of the drying air blower 26 through the flexible and expandable tube 27. The wash load 35 sticking to the inner wall of inner tub 13 at the end of the spin-drying process is peeled off the inner wall by a rotating action of the pulsator 16, and is rotated along the slope region 17 of pulsator 16 to be hauled up by the ribs 18 extending in radial direction. The wash load 35 agitated and hauled upward is exposed to the hot air. The hot air evaporates the humidity contained in wash load 35 to dry up the wash load 35, the hot air itself becomes humid air and proceeds through the holes of the side wall of inner tub 13, the space between fluid balancer 15 and separation board 28, and the space between outer wall of inner tub 13 and inner wall of outer tub 14, eventually reaching the connection duct 29 provided at the bottom of outer tub 14. Then, it proceeds, following the arrow marks, passing through the heat exchanger 31, the heater 25, again reaching the drying air blower 26. During the travelling, the hot air of high humidity makes contact with the inner wall of outer tub 14, the inner wall of heat exchanger 31, etc. constituting part of the circulation channel. The heat is exchanged and the air is dehydrated at these surfaces. By the time the air reaches the heater 25, it has become cooled dry air. The dry air is heated again by the heater 25 and passes through the wash load 35. The drying process proceeds by repetition of a cycle of the above-described procedures.

The hot air circulates in a circulation channel formed by the connection duct 29, the heat exchanger 31, the hot air supply channel 24, etc. As the circulating air is heading for the water discharge-switching valve 30 located in the lower end, it passes evenly through the wash load 35 within the inner tub 13. Therefore, the wash load dries up evenly. Since the heat exchanger 31, which is a part of the circulation channel, is disposed outside the cabinet 20, its surface is always cool, contributing to the efficient dehydration at the heat exchanger 31. Therefore, the wash load dries up quickly and dehydration water generated as a result of heat exchange conducted in the heat exchanger 31 is discharged through the drain hole 33.

As describe in the above, a wash load 35 is agitated during the drying process by pulsator 16, and is blown with the hot air heated by the heater 25 and delivered by the drying air blower 26 within the inner tub 13, and the hot air is heat-exchanged at the heat exchanger 31 for dehydration in order to dry up the wash load with the dehydrated air. Besides the heat exchange conducted at the heat exchanger 31, the hot air is also heat-exchanged at the inside of outer tub 14 and such other places. Therefore, the drying time is shortened and the unevenness in the drying of the wash load 35 is improved to an increased drying efficiency. Furthermore, because the hot air supply channel 24 containing the heater 25 and the drying air blower 26, the heat exchanger 31, etc. are not attached on the outer tub 14, the vibration caused during operation, especially during the spin-drying process, is lessened.

As the hot air supply channel 24 forms a circulation channel taking the air from the inner tub 13, heating it with the heater 25 and delivering it into the inner tub 13, and since the heat exchange is conducted either within the inside of the outer tub 14 or at the heat exchanger 31 provided in the circulation channel, the heat exchange performance has been raised. Such a structure contributes to presenting a washer-dryer, which is compact in size yet has a high drying efficiency. Furthermore, since the heat exchanger 31 is disposed outside the cabinet 20 so heat exchange takes place through the air-cooling principle, the heat exchange proceeds while the hot air is circulating in the circulation channel, including in the heat exchanger 31. This factor makes a further contribution in presenting a compact washer-dryer of high drying efficiency.

The pulsator 16 is disposed freely rotatable in the inner bottom of inner tub 13. It has a slope region 17 in the outer circumference and is provided with a plurality of ribs 18 extending in radial directions across the slope region 17 almost reaching the edge. Therefore, a wash load 35 is hauled upward and agitated by the ribs 18 of radial directions as a result of rotation of the pulsator 16. The hauled up wash load 35 is exposed to the hot air to improve the efficiency of drying. Thus the drying time is shortened, the drying efficiency is raised and the unevenness of drying is prevented. Furthermore, as the control means 34 controls so as the number of rotations of pulsator 16 during washing process is different from that in the drying process, the pulsator 16 may be driven at an own optimum rotation speed for the washing process and the drying process, respectively. Thus the efficiency of washing and the efficiency of drying may be improved altogether.

Although in the present embodiment a closed circulation channel has been formed by connecting the heat exchanger 31 coupled with the outer tub 14 via the connection duct 29 to the hot air supply channel 24, the same function and effect are obtainable even if such a closed circulation channel is not formed, without connecting the heat exchanger 31 to the hot air supply channel 24.

The heat exchanger 31 in the present embodiment has been designed based on the air-cooling principle. However, it may be structured instead to be based on the water-cooling principle.

A second exemplary embodiment of the present invention is described with reference to FIG. 2.

Figure 2:
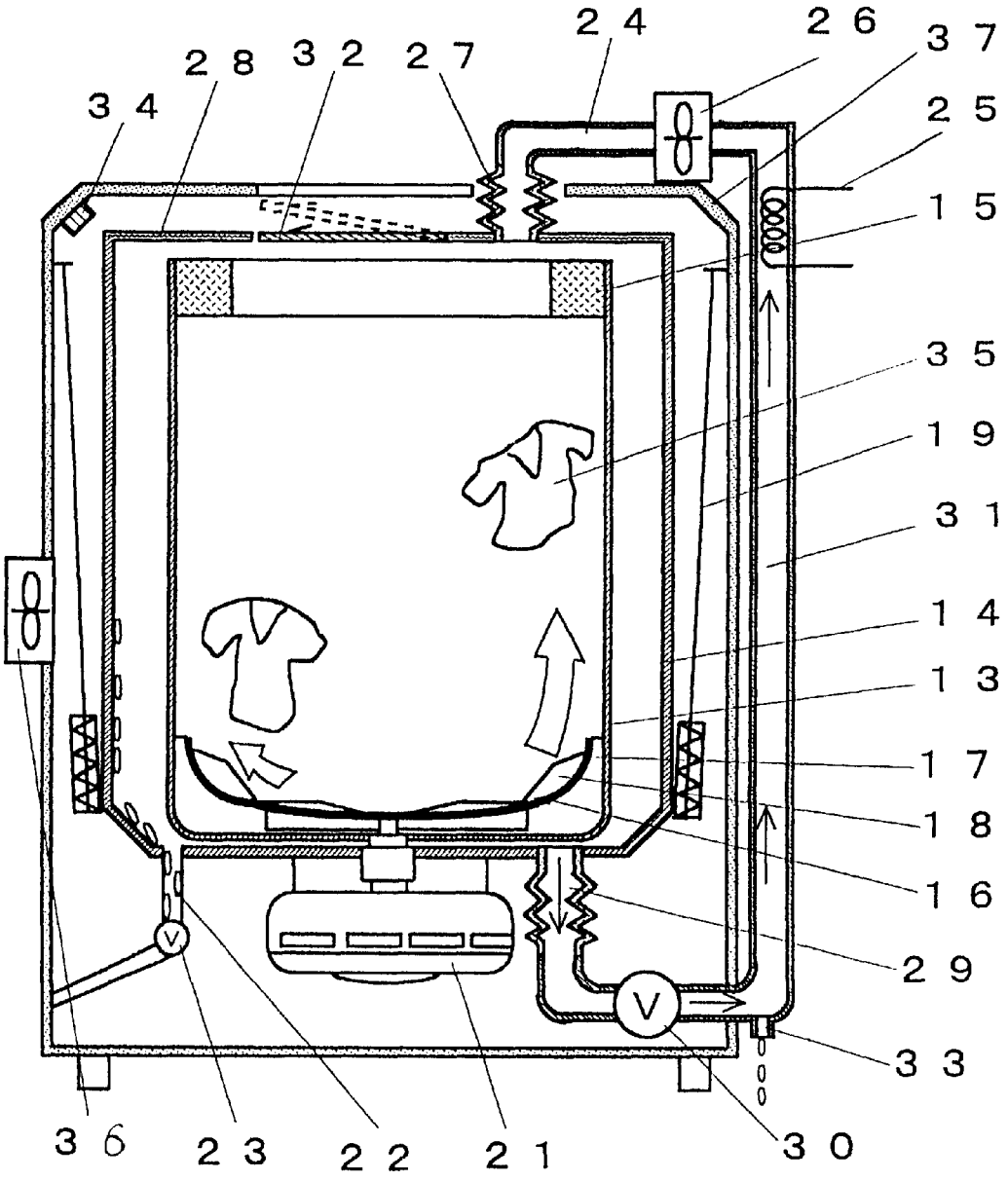
FIG. 2 is a vertical cross sectional view of a washer-dryer in accordance with a second exemplary embodiment of the present invention.

As shown in FIG. 2, a cooling air blower 36 is provided in a side face of cabinet 37 in order to introduce the outside air for cooling an outer tub 14. The other structures remain the same as those of the embodiment 1 above. Therefore, the same symbols are used to represent such portions and the descriptions are not repeated here.

The operation of the above-described structure is described below. The operations during the washing process until the spin-drying process remain the same as in the embodiment 1, so no description is given on these operations.

When the drying process is initiated, after the spin-drying process is over, the cooling air blower 36 starts its operation to take cooling air (outside air) in from outside of the cabinet 37. The cooling air is blown into the outer tub 14. The inside of the outer tub 14 is cooled down and the humid hot air flowing inside the outer tub 14 is efficiently heat-exchanged and dehydrated. Thus the heat exchange performance is improved and a wash load is dried quickly.

Although the heat exchanger 31, the heater 25 and the drying air blower 26 are disposed outside the cabinet 37 in the present embodiment, these items may be disposed instead on the inside of the cabinet 37. Then, the heat exchanger 31 is cooled by the cooling air introduced from outside of the cabinet 37 by the cooling air blower 36. In this way, the humid hot air flowing in the heat exchanger 31 may be heat-exchanged and dehydrated efficiently and a wash load may be dried more quickly.

A third exemplary embodiment of the present invention is described below referring to FIG. 3 and FIG. 4.

Figure 3:
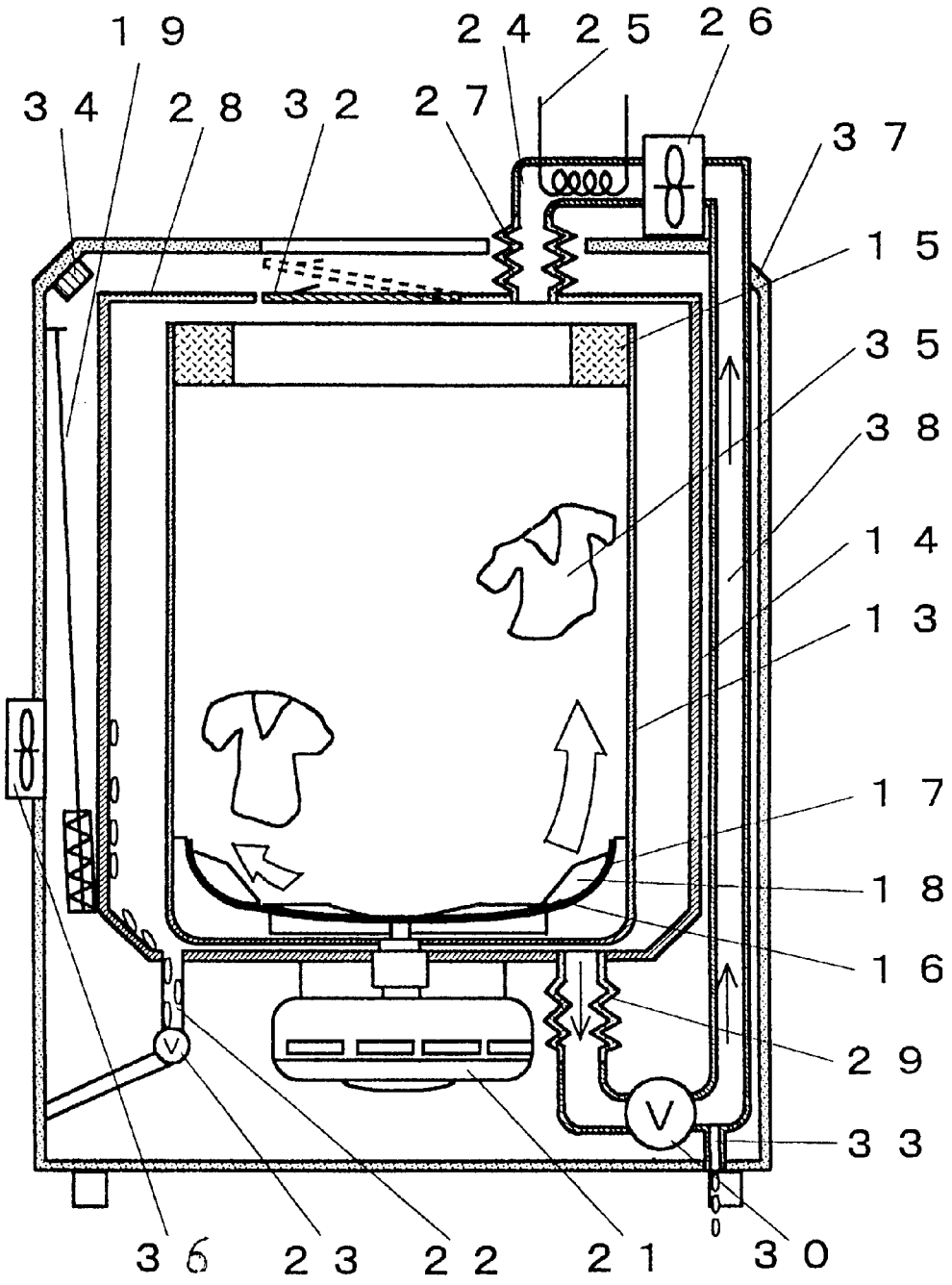
FIG. 3 is a vertical cross sectional view of a washer-dryer in accordance with a third exemplary embodiment of the present invention.
Figure 4:
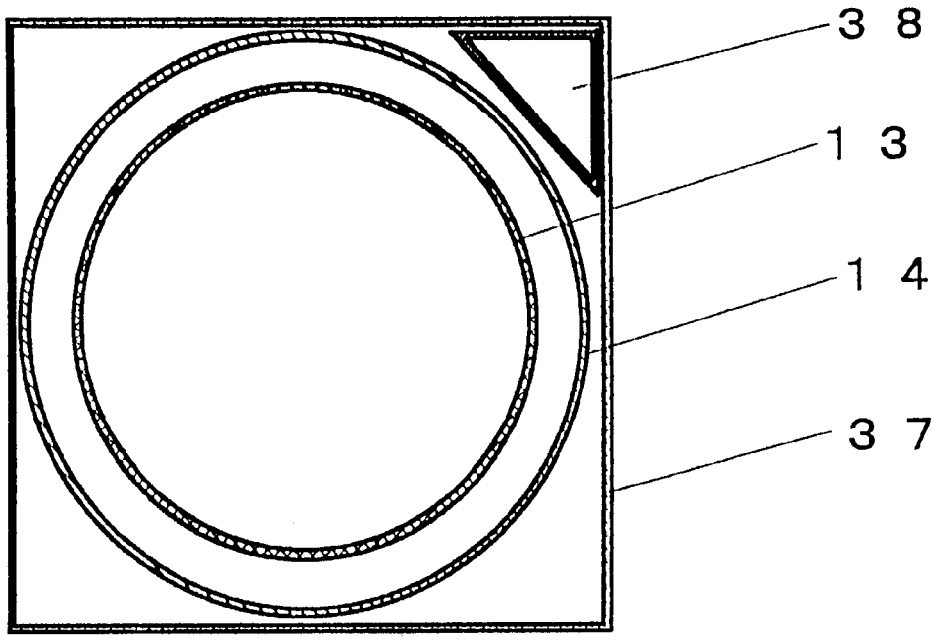
FIG. 4 is a horizontal cross sectional view of the above washer-dryer.

As shown in FIG. 3 and FIG. 4, a heat exchanger 38 is connected to the outer tub 14 via a connection duct 29. It is also connected to a hot air supply channel 24 which has a built-in heater 25 and a drying air blower 26. A circulation channel for circulating the hot air heated by the heater 25 is thus formed to air-cool the humid hot air for conducting the heat exchange and the dehydration. The heat exchanger 38 is disposed inside the cabinet 37 at a corner. Other structures remain the same as in the embodiment 2. Therefore, the same symbols are used to represent these portions and the description is not repeated here.

The operation under the above-described structure is described. The operations from the washing process until the spending process remain the same as in the embodiment 2. Therefore, the description of these operations is omitted here.

When a drying process is initiated, after the spin-drying process is over, the humid hot air makes contact with the inner wall of outer tub 14 and the inner wall of heat exchanger 38 forming part of the circulation channel. At these surfaces the hot air is heat-exchanged and dehydrated to become cool dry air at the time when it arrives at the heater 25. The dry air is heated again by the heater 25 to be delivered to the wash load 35. The drying process proceeds by repeating a cycle of the above procedures. As the heat exchanger 38 is disposed at a corner of the cabinet 37, the washer-dryer may be fabricated in a compact profile.

Figure 5:
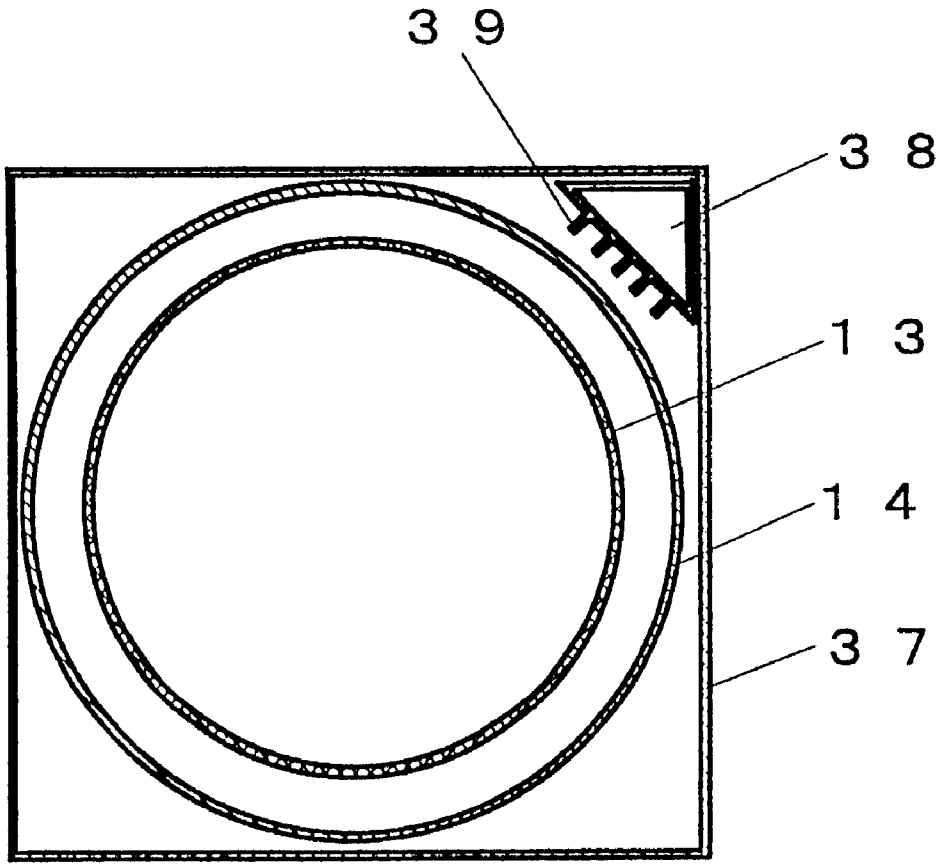
FIG. 5 is a horizontal cross sectional view of a washer-dryer of another example.

The heat radiating capacity may be increased by providing a plurality of heat radiation fins 39 on the outer wall surface of heat exchanger 38 constituting the circulation channel, as illustrated in FIG. 5. As the heat radiation fins 39 remarkably increase the heat radiating performance, the heat exchanging capacity of heat exchanger 38 is significantly raised. This helps implement a washer-dryer that is compact yet has a highly efficient drying capability.

Although the heat radiation fins 39 are provided on the outer wall surface of heat exchanger 38 in FIG. 5, the heat radiation fins may be provided instead on the inner wall surface for obtaining the same effects.

A fourth exemplary embodiment of the present invention is described below referring to FIG. 6.

Figure 6:
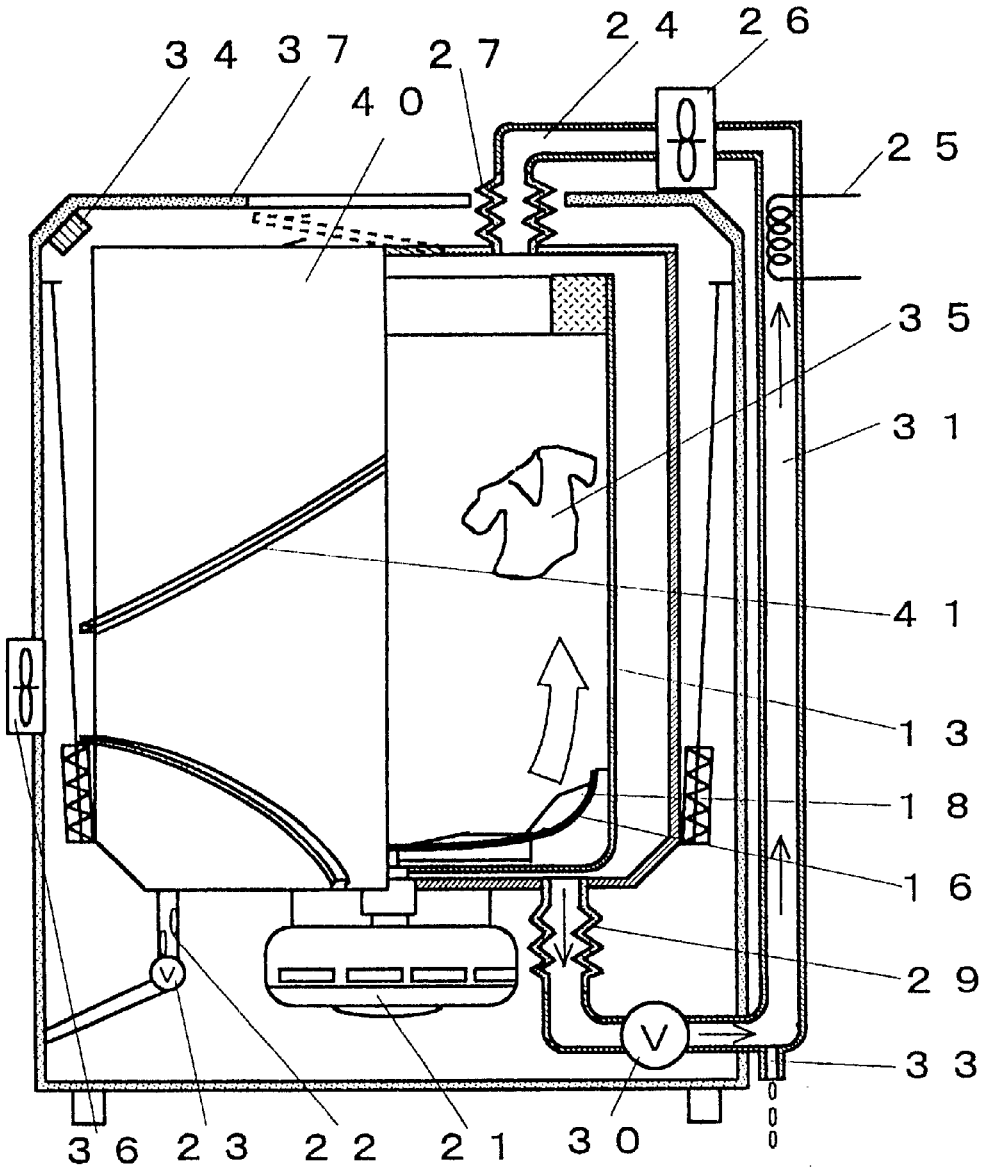
FIG. 6 is a partially cut-off vertical cross sectional view of a washer-dryer in accordance with a fourth exemplary embodiment of the present invention.

As shown in FIG. 6, an outer tub 40 is provided on its outer surface with a protruding guide wall 41 of a fin shape, which guide wall 41 being disposed starting from a place facing to a cooling air blower 36 so as to guide the air taken in from outside and to discharge the heat in the outer tub. The other structures remain the same as in the embodiment 2. Therefore, the same symbols are used to represent these portions and the description is not repeated here.

The operation under the above-described structure is described. The operations form the washing process until the spin-drying process remain the same as in the embodiment 1. Therefore, the description on these operations is omitted here.

When a drying process is initiated, after the spin-drying process is over, the humid hot air makes contact with the inner wall of outer tub 40 and the inner wall of heat exchanger 31 forming part of the circulation channel. At these surfaces the hot air is heat-exchanged and dehydrated to become cool dry air at the time when it arrives at the heater 25. The dry air is heated again by the heater 25 to be delivered to the wash load 35. The drying process proceeds by repeating a cycle of the above procedures. The outside air taken in by the cooling air blower 36 is guided by the guide wall 41 provided on the side wall of outer tub 40 to travel around the entire surface of outer tub 40 along the guide wall 41. As the guide wall 41 functions also as a cooling fin and the blown air travels along the guide wall 41 around the entire surface of outer tub 40, the heat radiation characteristics at the surface of outer tub 40 are improved. This results in significantly improved heat exchange characteristics and much improved drying efficiency.

A fifth exemplary embodiment of the present invention is described with reference to FIG. 7.

Figure 7:
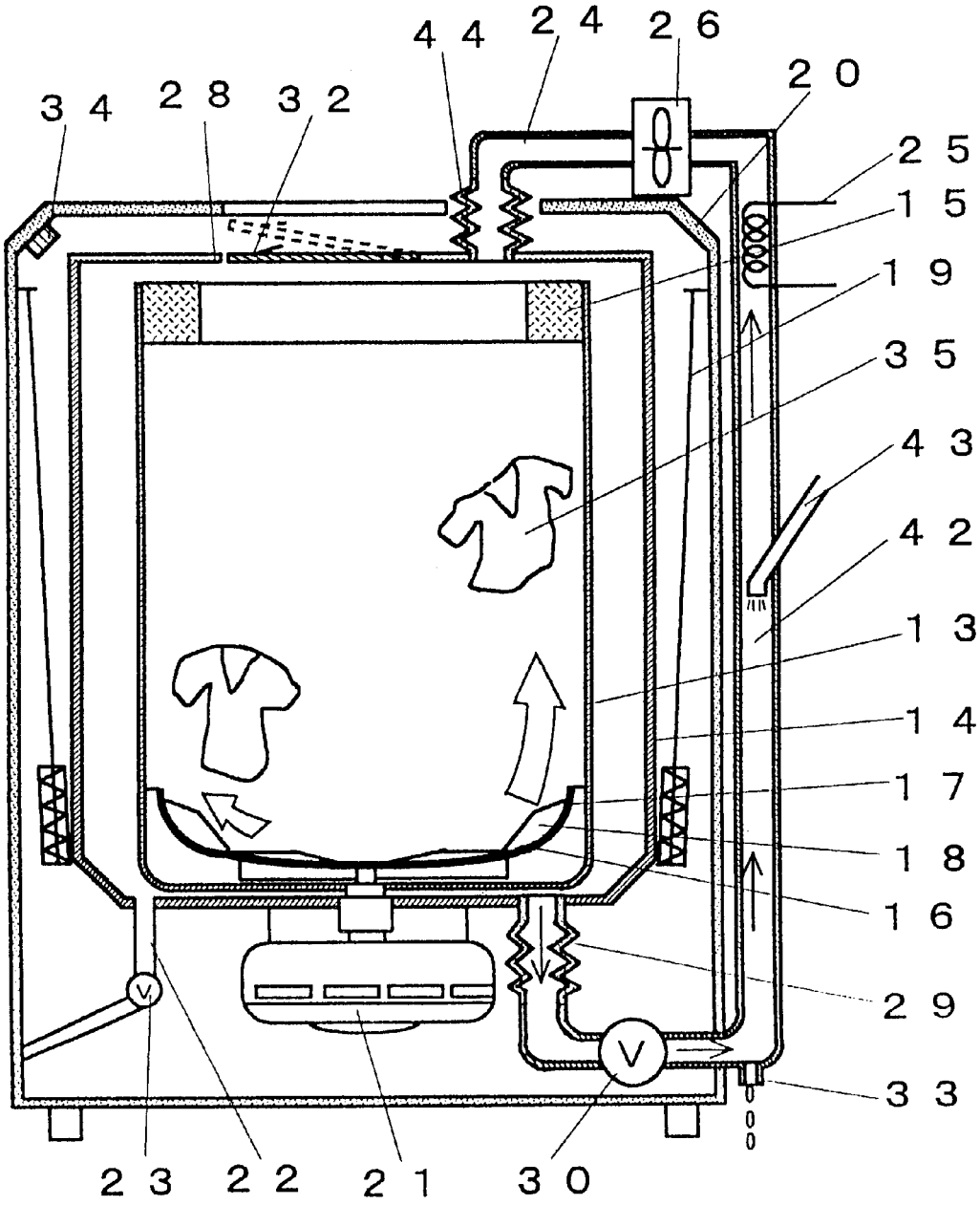
FIG. 7 is a vertical cross sectional view of a washer-dryer in accordance with a fifth exemplary embodiment of the present invention.

As shown in FIG. 7, the heat exchanger 42 is provided with a water supply section 43. The heat exchange is conducted with the water-cooling principle for dehydration. The hot air supply channel 24 containing the built-in heater 25 and a drying air blower 26 is connected via a flexible and expandable tube 44 of bellows shape to a separation board 28 provided at the top of outer tub 14. An almost closed circulation channel is formed by the connection duct 29, the heat exchanger 42, the hot air supply channel 24, etc. The flexible and expandable tube 44 of bellows shape is disposed in an approximately vertical direction. Other structures remain the same as those in the embodiment 1. The same symbols are used to represent these portions and the description is not repeated here.

The operation under the above-described structure is described in the following. The operations from the washing process until the spin-drying process remain the same as in the embodiment 1. Therefore, the description of these operations is omitted here.

In the drying process, the water discharge-switching valve 30 is opened. Hot air created by the heat generation of heater 25 is delivered into the inner tub 13 by the operation of the drying air blower 26 through the flexible and expandable tube 44. A spin-dried wash load 35 is peeled off the inner wall by a rotating action of the pulsator 16, and is hauled up by the ribs 18 extending in radial directions on the pulsator 16. The wash load 35 agitated and hauled upward is exposed to the hot air. The hot air absorbs the humidity contained in wash load 35 to make itself a humid hot air, which proceeds along the side wall of inner tub 13, passes through the space between outer surface of inner tub 13 and inner surface of outer tub 14, reaching the connection duct 29 provided at the bottom of outer tub 14. Then, the humid hot air proceeds following the arrow marks, passing through the heat exchanger 42, the heater 25, again reaching the drying air blower 26. During the travelling in the heat exchanger 42, the hot air of high humidity is cooled by the water supplied from the water supply section 43 and dehydrated. By the time it reaches the heater 25 it has become a cooled dry air. The dry air is heated again by the heater 25 and goes through the wash load 35. The drying process proceeds by repetition of a cycle of the above-described procedures.

While a washer-dryer is in operation during the above processes, the pulsator 16 or the inner tub 13 is rotating. As a result, the outer tub 14 and other members suspended by a suspension gear 19 make vibrations in up-down directions and/or oscillatory directions. The vibrations, in so far as they are the free vibrations, are absorbed by a plurality of suspension gears 19 supporting the outer tub 14, and a cabinet 20 is not quite affected by the vibrations. Considering the nature of vibrations in the present embodiment, although the cabinet 20 and the separation board 28 on the outer tub 14 are connected with the flexible and expandable tube 44, the vibrations of the vibrating member are not restricted, neither in up-down nor oscillatory directions, because the flexible and expandable tube has been disposed in a substantially vertical direction and has a shape of bellows. Therefore, the nature of free vibration is maintained.

The vibration of a cabinet 20 due to vibrations of the outer tub 14 and other vibrating members supported by a suspension gear 19 is thus reduced. So, a washer-dryer of less vibration is presented in accordance with the present invention.

Although the heat exchanger 42 is provided with a water supply section 43 for conducting the heat-exchange based on the water-cooling principle in the present embodiment, it may of course be conducted with the air-cooling principle, in the same way as in the embodiment 1.

A sixth exemplary embodiment of the present invention is described in the following with reference to FIG. 8.

Figure 8:
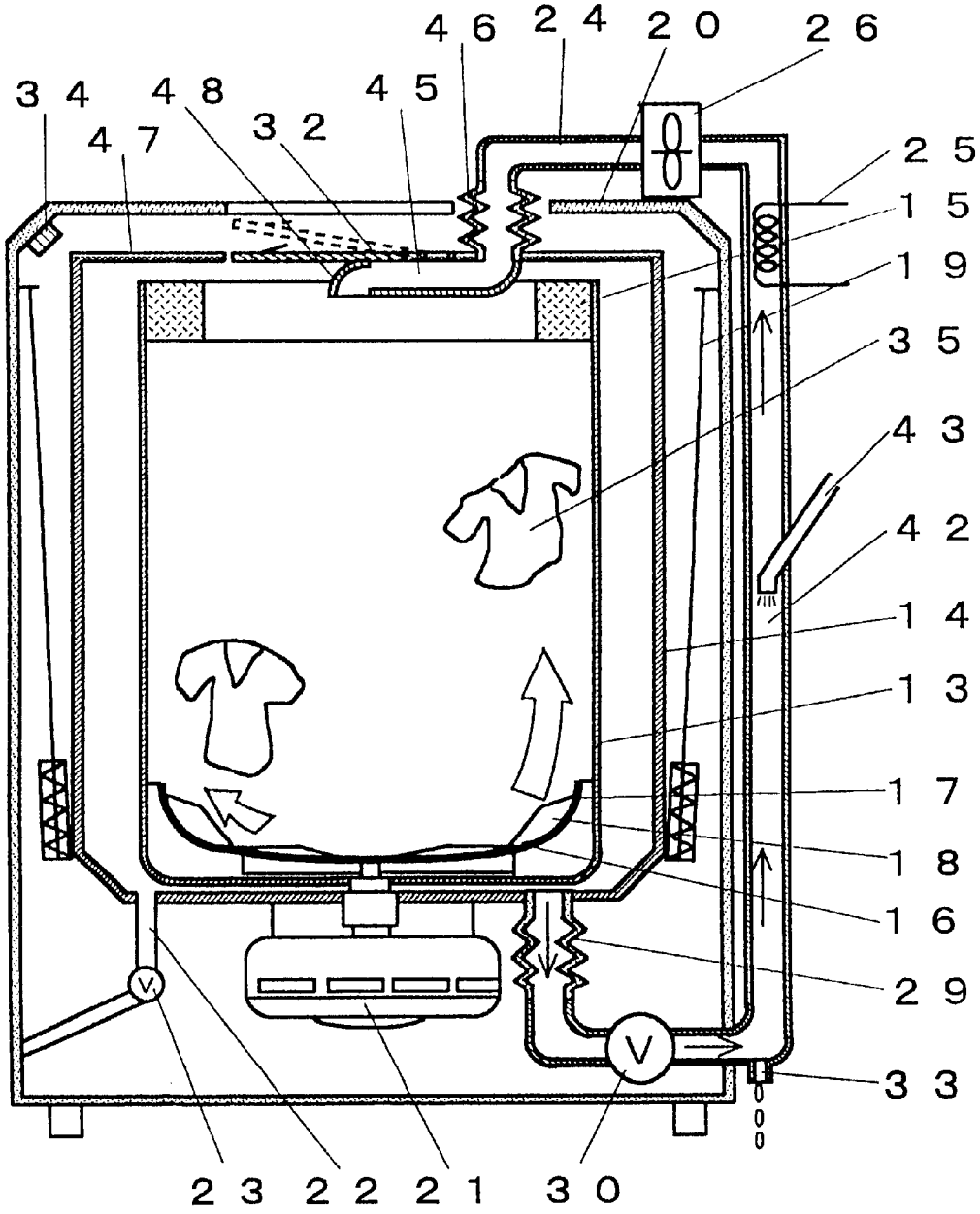
FIG. 8 is a vertical cross sectional view of a washer-dryer in accordance with a sixth exemplary embodiment of the present invention.

As shown in FIG. 8, an empty path 45 is provided on the surface of separation board 47 facing the inner tub 13, coupling through with the flexible and expandable tube 46. The empty path 45 extends as far as to substantially the center of the separation board 47. At the exit of empty path 45 is a guide 48 provided for guiding the air coming from the empty path 45 towards substantially the center of the inner tub 13. The other structures remain the same as those in the above embodiment 5. The same symbols are used to represent these portions and the description of which is not repeated here.

The operation under the above-described structure is described in the following. The operations from the washing process until the spin-drying process remain the same as in the embodiment 5. Therefore, the description of these operations is omitted here.

In the drying process, the water discharge-switching valve 30 is opened. Hot air created by the heat generation of heater 25 is delivered into the inner tub 13 by the operation of the drying air blower 26 through the flexible and expandable tube 46 and the separation board 47. In the present embodiment, an empty path 45 is provided extending as far as approximately the center of the separation board 47. Therefore, the hot air proceeds along the empty path 45 to substantially the center of the separation board 47. The hot air is directed downward into the inner tub 13 guided by the guide 48 provided at the exit of empty path. Thus the hot air is delivered efficiently to the wash load 35 locating in the inner tub 13. The efficiency of drying is improved and the drying time is shortened. Eventually, the total time needed through the processes from washing to drying is reduced.

A seventh exemplary embodiment of the present invention is described in the following with reference to FIG. 9.

Figure 9:
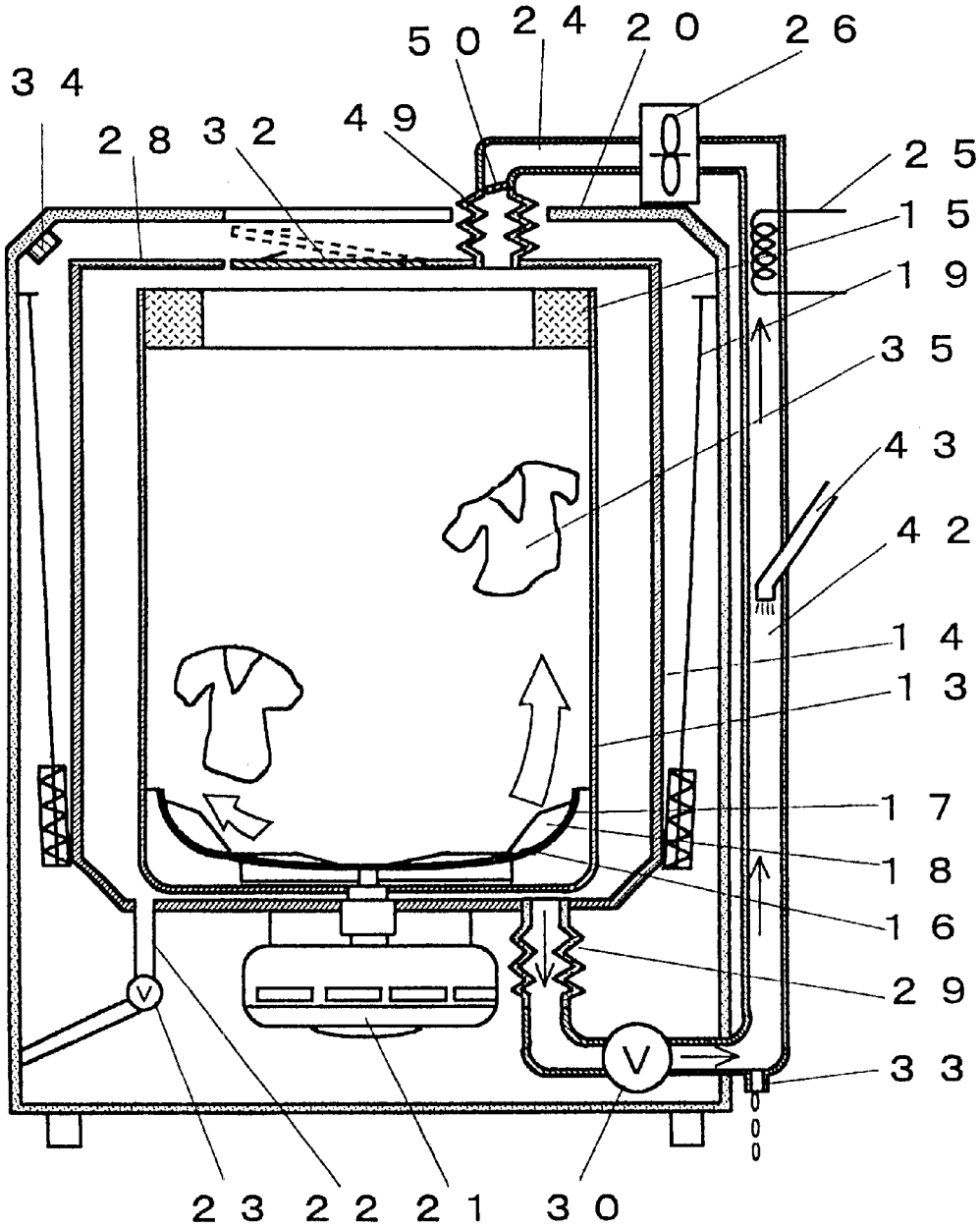
FIG. 9 is a vertical cross sectional view of a washer-dryer in accordance with a seventh exemplary embodiment of the present invention.

As shown in FIG. 9, the flexible and expandable tube 49 is provided with a non-return valve 50 located inside. The non-return valve 50 opens when the hot air goes from the hot air supply channel 24 to the inner tub 13, whereas it closes at a reverse flow. The other structures remain the same as those in the above embodiment 5. The same symbols are used to represent these portions and the description of which is not repeated here.

The operation under the above-described structure is described in the following. The operations from the washing process until the spin-drying process remain the same as in the embodiment 5. Therefore, the description of these operations is omitted here.

In the drying process, the water discharge-switching valve 30 is opened. Hot air created by the heat generation of heater 25 is delivered into the inner tub 13 by the operation of the drying air blower 26 through the flexible and expandable tube 49 and the separation board 28. If during a washing process, for example, water or foam of detergent is intruding into the hot air supply channel 24 from the flexible and expandable tube 49, namely if something is coming towards the drying air blower 26 or the heater 25, the intrusion is halted by the non-return valve 50. Thus an intrusion of unwanted items with reverse flow is avoided for assuring higher safety.

An eighth exemplary embodiment of the present invention is described below referring to FIG. 10.

Figure 10:
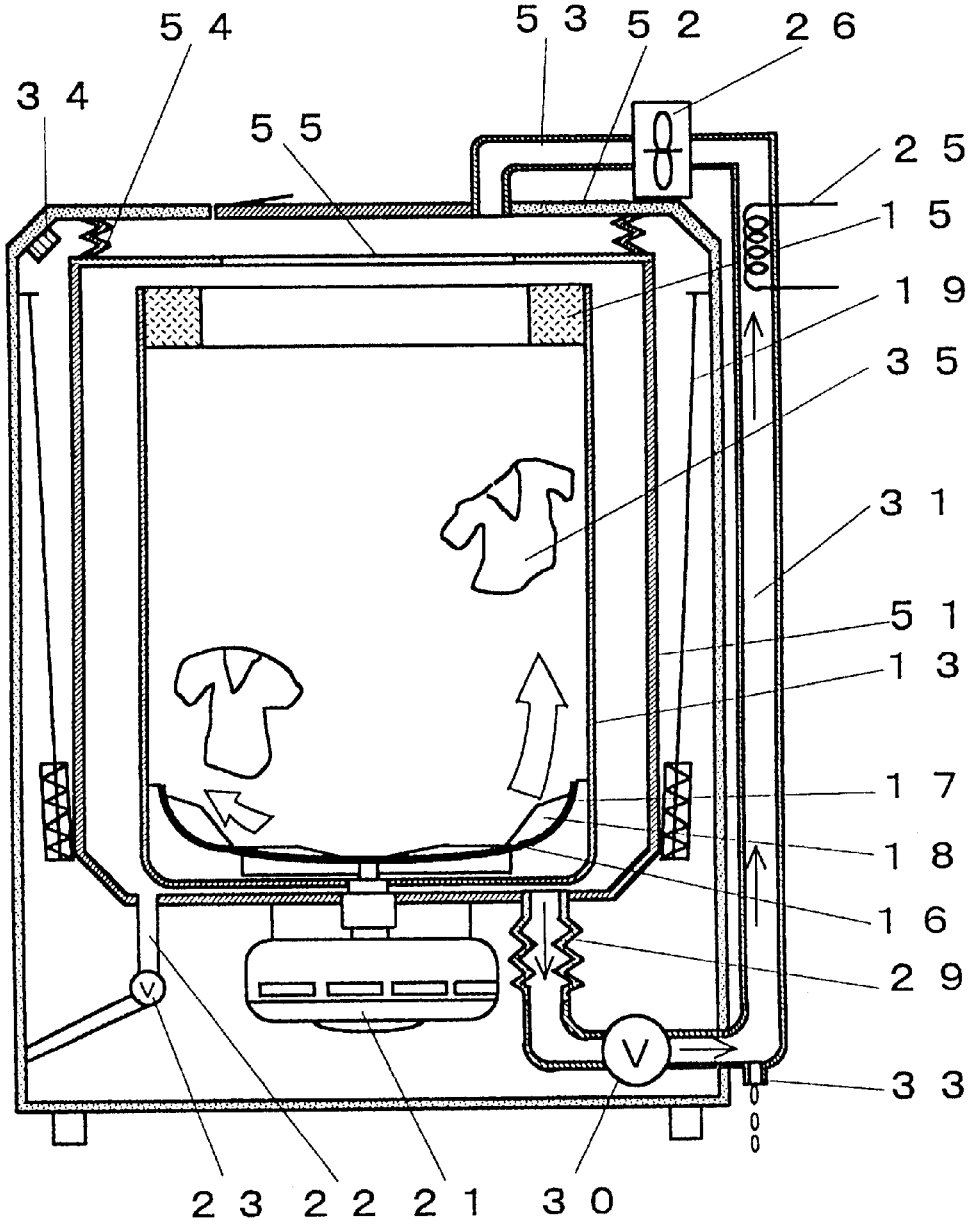
FIG. 10 is a vertical cross sectional view of a washer-dryer in accordance with an eighth exemplary embodiment of the present invention.

As shown in FIG. 10, an outer tub 51 which houses in it an inner tub 13 rotating around a substantially vertical axis and functioning as a tub for washing and spin-drying is suspended in a cabinet 52 with a suspension gear 19 for the sake of anti-vibration. A hot air supply channel 53 is provided for supplying hot air into the inner tub 13 during the drying process. The hot air supply channel 53 comprises a heater 25 for heating the air and a drying air blower 26 for delivering the hot air into the inner tub 13, and is connected to the cabinet 52. A flexible and expandable tube 54 is provided to enclosing the outer circumference of an opening 55 for throwing a washing into the inner tub 13, connecting the outer tub (vibrating end) 51 with the cabinet (stationary end) 52. The other structures remain the same as those of the embodiment 1 above. The same symbols are used to represent these portions and description of which is not repeated here.

The operation under the above-described structure is described in the following. The operation in the washing process remains the same as in the embodiment 1. Therefore, the description of the operation is omitted here.

A spin-drying process begins, after the washing process is over, with opening of the water discharge valve 23 for discharging the water in the inner tub 13, and a clutch built in a motor 21 is switched to the spin-dry side to convey the rotating force of the motor 21 to the inner tub 13 via a spin-dry shaft. The inner tub 13 is rotated at a high speed and a wash load is spin-dried by a centrifugal force. The outer tub 51 supported by the suspension gear 19 is vibrated by the rotating inner tub 13. The vibration is conveyed to the cabinet 52, which is vibrated during the spin-drying process.

As the outer tub (vibrating end) 51 and the cabinet (stationary end) 52 are connected by the flexible and expandable tube 54, conduction of the vibration of outer tub (vibrating end) 51 to the cabinet (stationary end) 52 is absorbed by the flexible and expandable tube 54. So, the vibration at cabinet 52 is suppressed. Furthermore, the flexible and expandable tube 54 has been disposed enclosing the entire circumference of the opening 55 provided for throwing in a wash load. The flexible and expandable tube 54 disposed in a well-balanced arrangement causes no jerking force in one specific direction. Thus the vibration is suppressed to a minimum.

In the drying process, the water discharge-switching valve 30 is opened and hot air created by the heat generation of heater 25 is delivered into the inner tub 13 by the operation of the drying air blower 26 through the flexible and expandable tube 54. The wash load 35 sticking to the inner wall of inner tub 13 after the spin-drying process is peeled off the inner wall by a rotating action of the pulsator 16, and is rotated along the slope region 17 of pulsator 16 to be hauled up by the ribs 18 extending in radial direction. The wash load 35 agitated and hauled upward are exposed to the hot air. The hot air evaporates the humidity contained in the washload 35 to dry it up. The hot air itself becomes a humid air and proceeds along the side wall of inner tub 13 and the space between outer wall of inner tub 13 and inner wall of outer tub 51, reaching the connection duct 29 provided at the bottom of outer tub 51. Then, the hot humid air proceeds following the arrow marks, passing through the heat exchanger 31, the heater 25, again reaching the drying air blower 26. During the travelling, the hot air of high humidity makes contact with the inner wall of outer tub 51, the inner wall of heat exchanger 31, etc. constituting part of the circulation channel. The heat is exchanged and the air is dehydrated at the surfaces. By the time it reaches the heater 25 it becomes a cooled dry air. The dry air is heated again by the heater 25 and goes through the wash load 35. The drying process proceeds by repetition of a cycle of the above-described procedures.

The flexible and expandable tube 54 has been connecting the outer tub (vibrating end) 51 and the cabinet (stationary end) 52 in a well-balanced manner by enclosing the entire circumference of the opening provided for throwing in a wash load. This structure contributes to suppress the vibration caused by rotation of the pulsator 16 or inner tub 13 during the washing, rinsing, spin-drying and drying processs.

A ninth exemplary embodiment of the present invention is described in the following with reference to FIG. 11.

Figure 11:
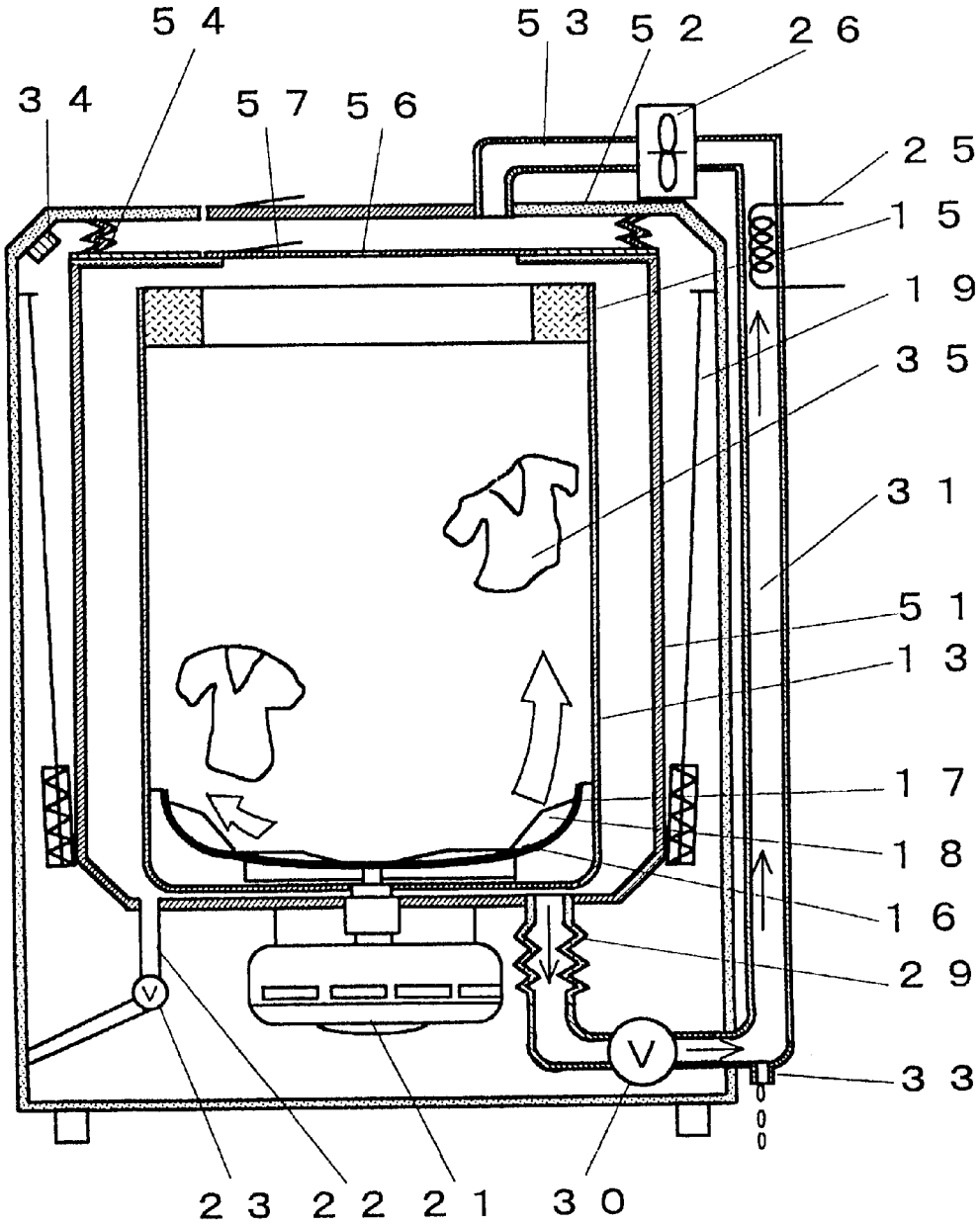
FIG. 11 is a vertical cross sectional view of a washer-dryer in accordance with a ninth exemplary embodiment of the present invention.

As shown in FIG. 11, a separation board 57 having a hot air entrance hole 56 is provided on the top of an outer tub 51. The other structures remain the same as those of the embodiment 8. The same symbols are used to represent these portions and the description is omitted here.

The operation under the above-described structure is described in the following. The operations from the washing process through the spin-drying process remain the same as in the embodiment 8 above. Therefore, the description of the operations is not repeated here.

In the drying process, the water discharge-switching valve 30 is opened and hot air created by the heat generation of heater 25 is delivered into the inner tub 13 by the operation of the drying air blower 26 through the hot air supply channel 53, the flexible and expandable tube 54 and the separation board 57. The hot air raises the temperature within the inner tub 13. By rotation of the pulsator 16, the wash load 35 is made to have contact with the hot air for drying. The hot air is guided by the hot air entrance hole 56 so that it is directed vertically downward at a place close to the wash load 35. In this way, the hot air makes contact with the wash load 35 while the temperature is high; which contributes to expedite the drying of wash load 35.

The separation board 57 having a hot air entrance hole 56 directs the flow of hot air vertically downward at a place close to the wash load 35. A wash load 35 may have contact with the hot air of high temperature, which contributes to shorten the time needed to dry up a wash load.

A tenth exemplary embodiment of the present invention is described in the following with reference to FIG. 12.

Figure 12:
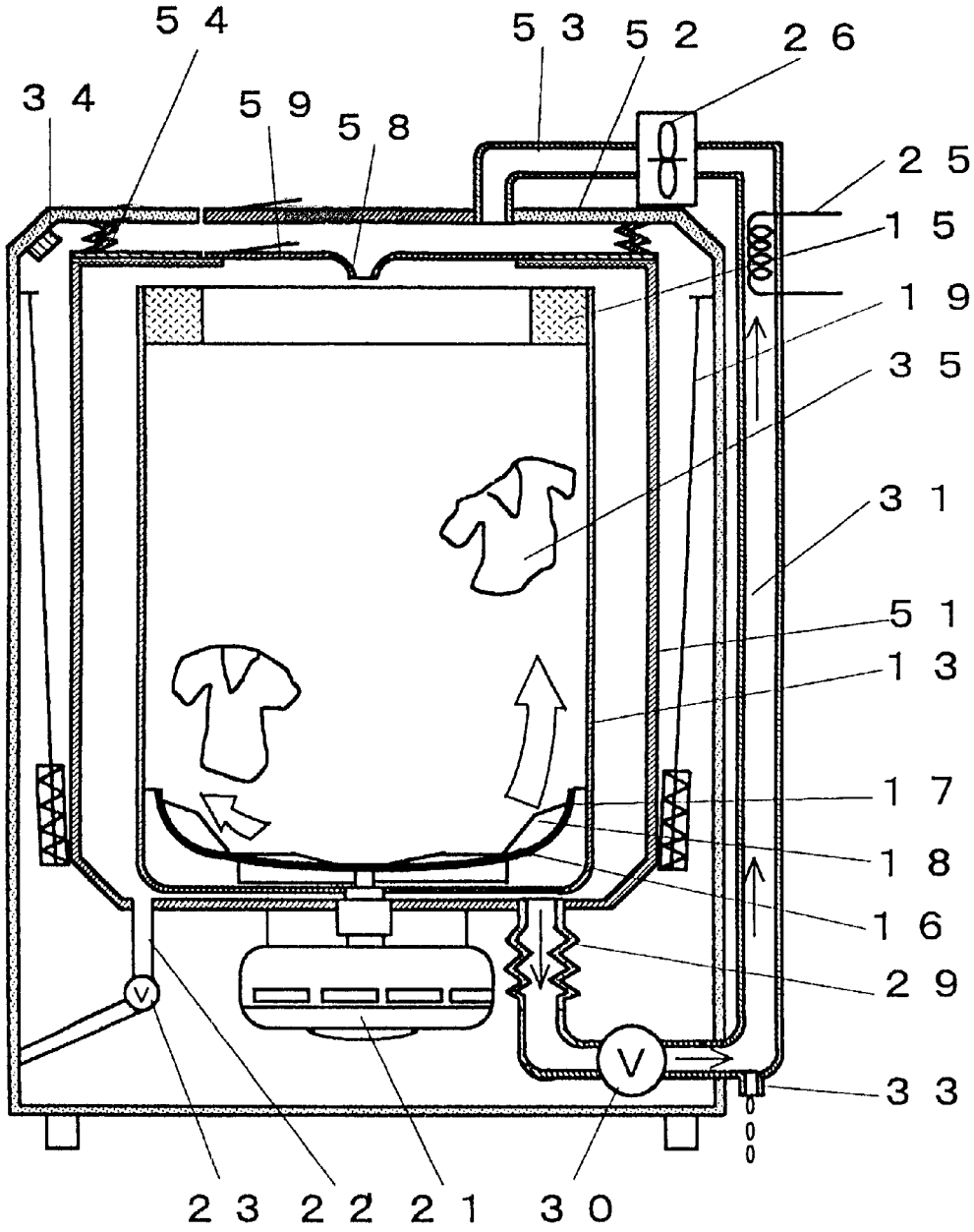
FIG. 12 is a vertical cross sectional view of a washer-dryer in accordance with a tenth exemplary embodiment of the present invention.

As shown in FIG. 12, a separation board 59 having a hot air entrance hole 58 is provided on the top of outer tub 51, the hot air entrance hole 58 having a contracting shape. The other structures remain the same as those of the embodiment 9. The same symbols are used to represent these portions and description of which is omitted here.

The operation under the above-described structure is described in the following. The operations from the washing process through the spin-drying process remain the same as in the embodiment 9 above. Therefore, the description of the operations is not repeated here.

In the drying process, the water discharge-switching valve 30 is opened and hot air created by the heat generation of heater 25 is delivered into the inner tub 13 by the operation of the drying air blower 26 through a hot air supply channel 53, a flexible and expandable tube 54 and the separation board 59. The temperature within the inner tub 13 is raised. By the rotation of pulsator 16, the wash load 15 is made to have contact with the hot air for drying. Because of the contracting shape of the hot air entrance hole 58 the hot air is blown vertically downward at a high flow velocity. Therefore, the hot air of high temperature actively makes contact with the wash load 35; which contributes to expedite the drying of the wash load 35.

By shaping the hot air entrance hole 58 in a contracting shape, the velocity of the vertical downward flow of hot air during drying process is increased. Thus the hot air of a high temperature reaches actively even to the wash load 35 staying at the bottom part of the inner tub 13. The time needed to dry up a wash load 35 can be reduced.

An eleventh exemplary embodiment of the present invention is described in the following with reference to FIG. 13.

Figure 13:
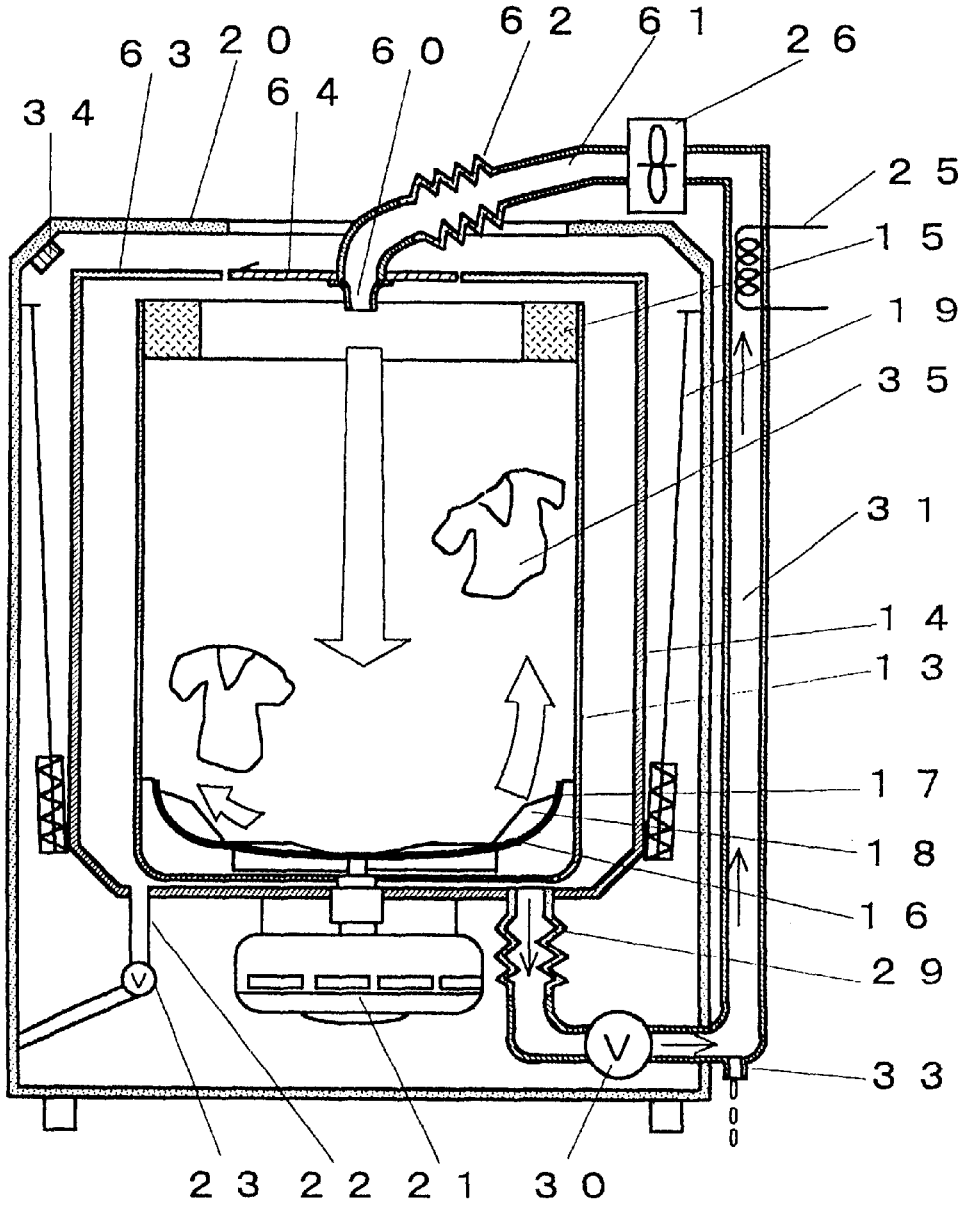
FIG. 13 is a vertical cross sectional view of a washer-dryer in accordance with an eleventh exemplary embodiment of the present invention.

As shown in FIG. 13, a gushing mouth 60 is provided to gush out the hot air delivered via the flexible and expandable tube 62 from the hot air supply channel 61 into the inner tub 13. A freely openable lid 64 is provided in the separation board 63 attached on the top of outer tub 14. The gushing mouth 60 is fixed to the lid 64. The cross sectional area of the gushing mouth 60 gradually decreases towards the exit so as to deliver the hot air at an increased flow velocity into the inner tub 13. Other structures remain the same as those of the embodiment 1. The same symbols are used to represent these portions and the description is omitted here.

The operation under the above-described structure is described in the following. The operations from the washing process through the spin-drying process remain the same as in the embodiment 1. Therefore, the description of the operations is not repeated here.

In the drying process, the water discharge-switching valve 30 is opened and hot air created by the heat generation of heater 25 is delivered into the inner tub 13 by the operation of the drying air blower 26 through the hot air supply channel 61, the flexible and expandable tube 62 and the gushing mouth 60. The temperature within the inner tub 13 goes up. By the rotation of pulsator 16, the wash load 35 is made to have contact with the hot air to be dried up. The hot air heats the wash load 35 and evaporates the humidity contained in the wash load, and then passes through the holes in the side wall of inner tub 13 and the space between a fluid balancer 15 and the separation board 63 reaching to the heat exchanger 31 via the connection duct 29. At the heat exchanger 31, the humid hot air is cooled and dehydrated, and dehydration water is discharged through the drain hole 33. The drying process proceeds along with the circulation and dehydration of hot air. In the meantime, pulsator 16 repeats the forward and reverse rotations to haul up and agitate the wash load 35 in order to help drying.

Because of the smoothly contracting flow area in the cross section of the gushing mouth 60, the hot air flow is heightened at a minimum pressure loss and blown into the inner tub 13 at an increased flow velocity. The hot air is blown with strength against the wash load 35 and permeates at a sufficient velocity down to the bottom portion of the inner tub 13. In this way, the wash load 35 is efficiently provided with the heat and the convection. Thus a wash load is dried within a short period of time with the least unevenness of drying. The reduced drying time contributes to the save-energy initiative.

In the present exemplary embodiment, it is to be noted that the time needed for drying and the evenness of the drying, which are the essential factors determining a drying performance, are closely interrelated to each other. Therefore, it is difficult in practice to clearly distinguish the cause from the countermeasure in each of the respective factors.

A twelfth exemplary embodiment of the present invention is described in the following with reference to FIG. 14 and FIG. 15.

Figure 14:
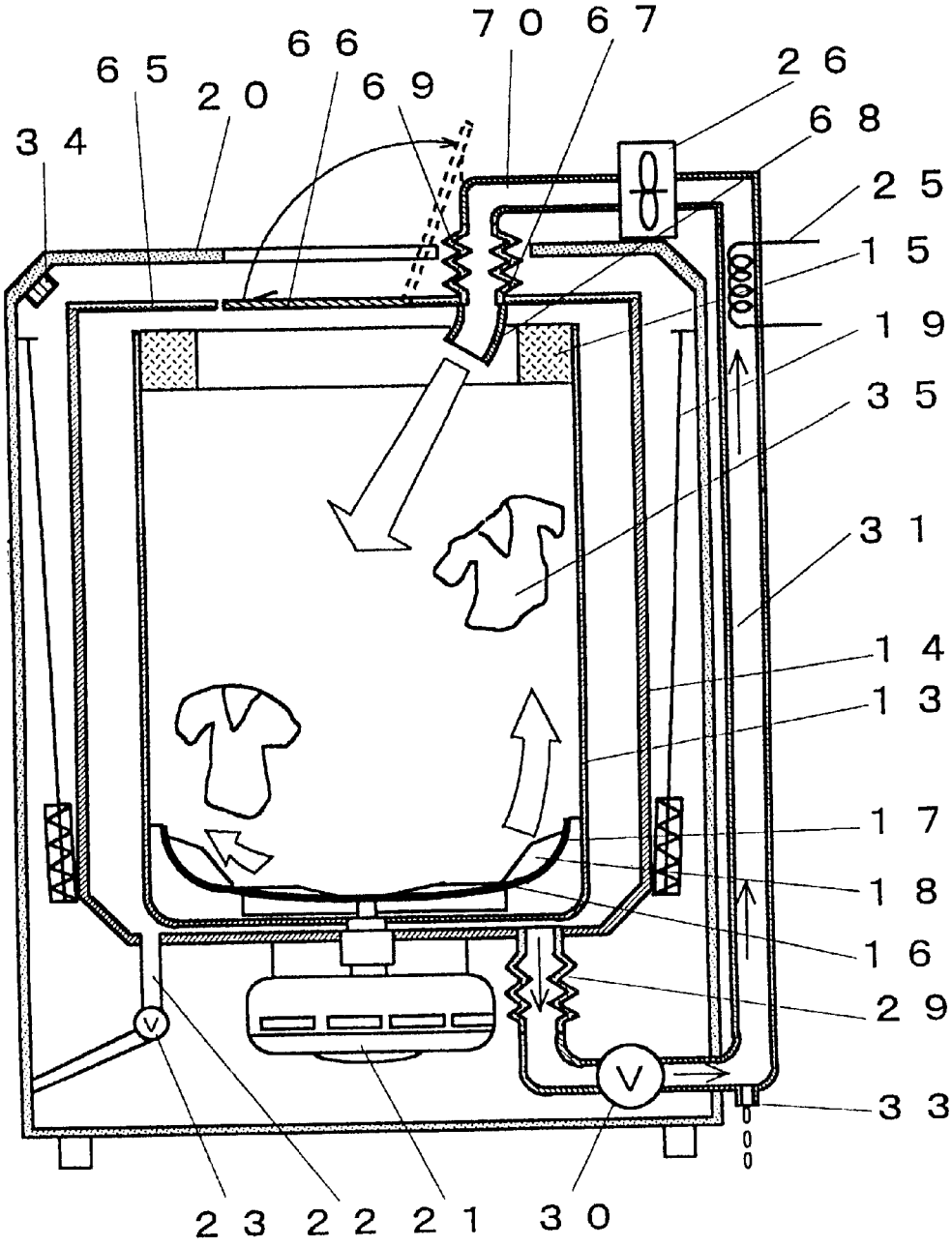
FIG. 14 is a vertical cross sectional view of a washer-dryer in accordance with a twelfth exemplary embodiment of the present invention.
Figure 15:
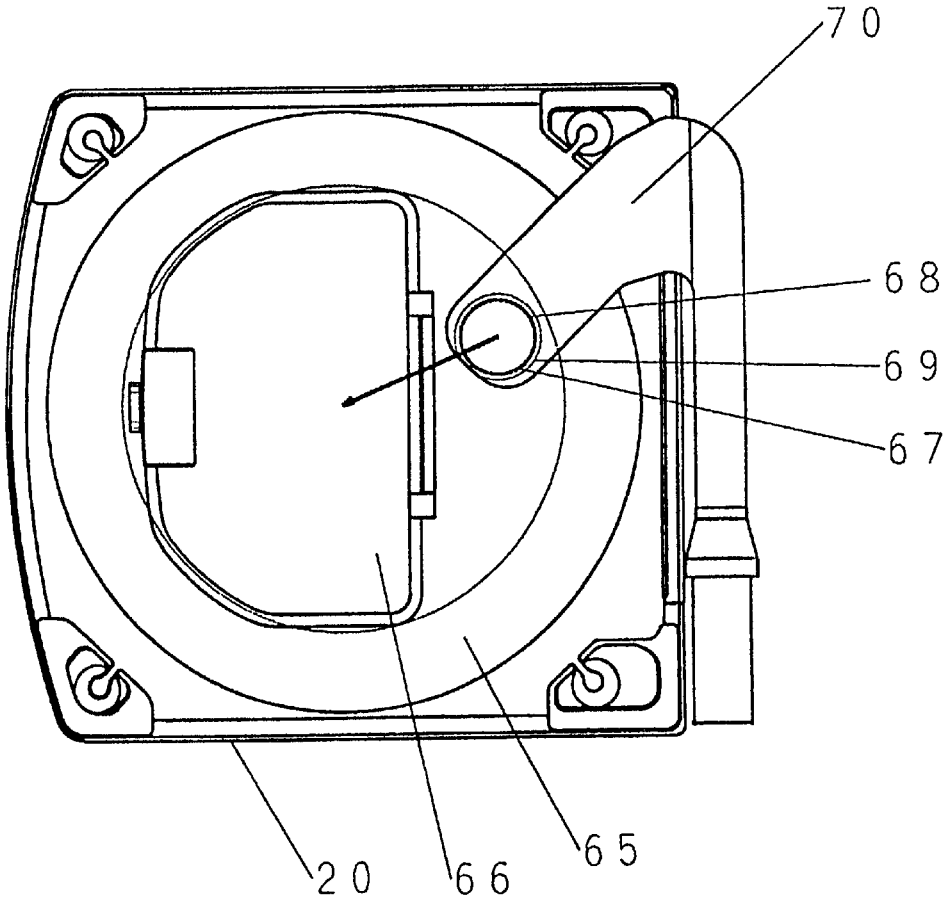
FIG. 15 is a partially cut-off plan view of the above washer-dryer.

As shown in FIG. 14 and FIG. 15, a freely openable lid 66 is provided in the separation board 65 attached on the top of the outer tub 14. The lid 66 is disposed in the front forward portion of the separation board 65 so as to be openable by a butterfly action around an axis supported by the separation board 65. The contact area of the separation board 65 and the lid 66 is provided with an airtight packing and a latch, or a magnet, so that it does not make an unwanted sudden opening. The separation board 65 is also provided with a hot air entrance hole 67 at the rear portion, being isolated from the freely openable lid 66. The hot air entrance hole 67 is provided with a gushing mouth 68, which is directly connected to and opens its mouth towards the bottom center of the inner tub 13. The hot air entrance hole 67 and the hot air supply channel 70 are connected by the flexible and expandable tube 69. The other structures remain the same as those of the embodiment 11 above. The same symbols are used to represent these portions and the description is omitted here.

The operation under the above-described structure is described in the following. The operations from the washing process through the spin-drying process remain the same as those in the embodiment 1. Therefore, the description of these operations is not repeated here.

In the drying process, the water discharge-switching valve 30 is opened and the hot air created by the heat generation of heater 25 is delivered into the inner tub 13 by the operation of the drying air blower 26. The hot air goes through the hot air supply channel 70, the flexible and expandable tube 69 and the gushing mouth 68, and the temperature within the inner tub 13 is raised. The wash load 35 is made to have contact with the hot air by the rotation of pulsator 16 to be dried.

During the operation from the washing process through the spin-drying process and in the drying process, the pulsator 16 or the inner tub 13 is rotating. Therefore, vibration is caused on the outer tub 14 and other vibrating members. Although the suspension gear 19, the connection duct 29, the flexible and expandable tube 69 absorb the vibration to a certain extent, the vibration can not be totally absorbed and the remaining part of vibration is conveyed to cabinet 20.

In the present embodiment, a freely openable lid 66 is provided in the front forward portion of the separation board 65, and the gushing mouth 68 and the hot air entrance hole 67 are provided in the rear portion. The above disposition layout on the separation board 65, namely, the isolation of the gushing mouth and the hot air entrance hole from the lid, makes the structure on an outer tub 14 simpler and lighter in weight as compared with that in the above embodiment 11. This contributes to suppress the vibration of the outer tub 14 during each of the processes.

The freely openable lid 66 seems to be most convenient for the practical use when disposed in such a layout that it opens to the direction as illustrated in the drawing with dotted lines. However, it may of course be provided instead in a form of an accordion curtain, or as a sliding shutter, for example. As another alternative, the separation board 65 itself may be made openable, eliminating the freely openable lid 66. This alternative, however, does not seem to be practical, because in practice the top portion of the cabinet 20 is occupied by an operation panel, a top cover and like items.

Like in the embodiment 11 above, it is to be noted that the time needed for drying and the evenness of the drying, which being the essential factors determining the drying performance, are closely interrelated to each other. Therefore, in practice, it is difficult to clearly distinguish the cause from the countermeasure for each of the respective factors.

A thirteenth exemplary embodiment of the present invention is described with reference to FIG. 16.

Figure 16:
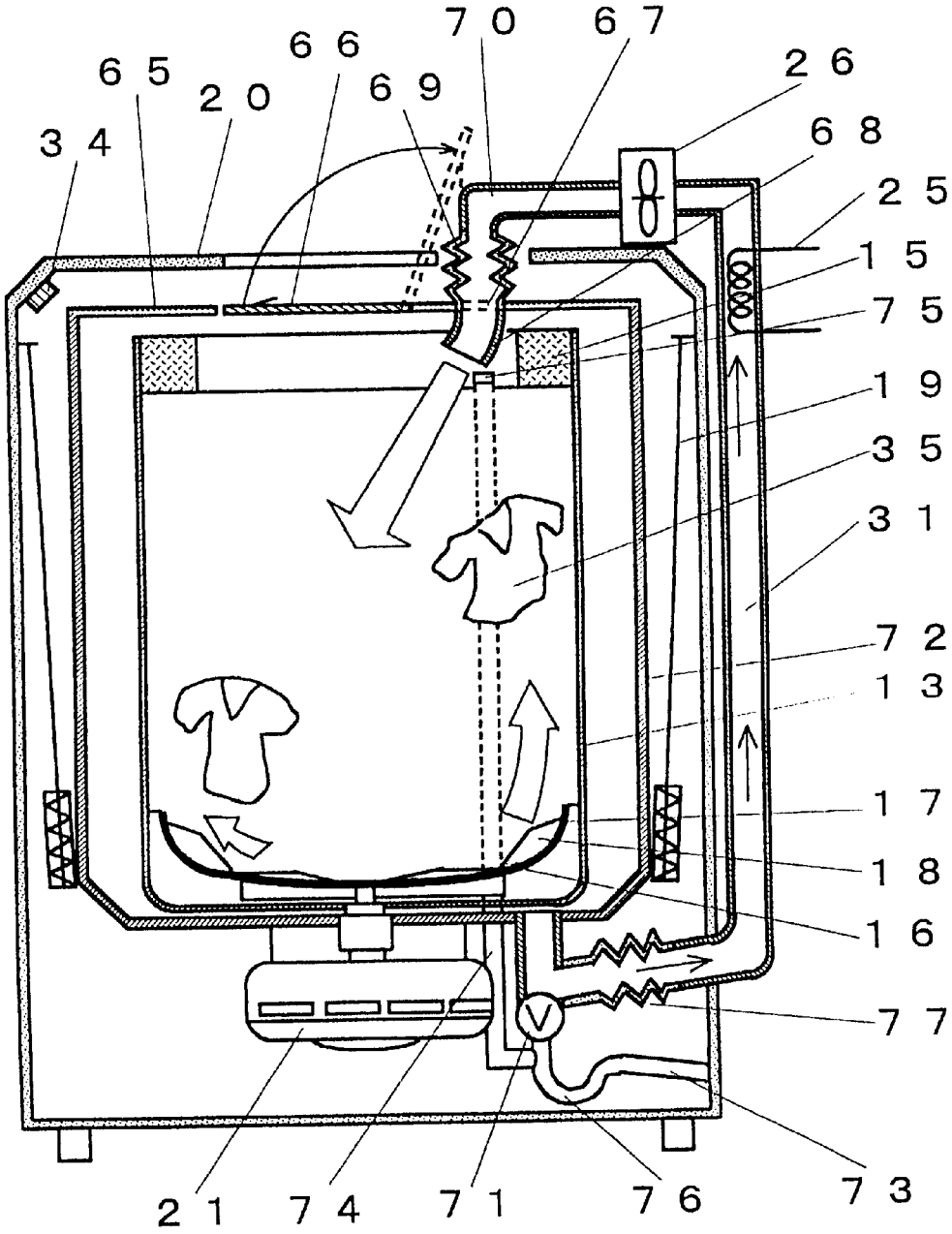
FIG. 16 is a vertical cross sectional view of a washer-dryer in accordance with a thirteenth exemplary embodiment of the present invention.

As shown in FIG. 16, a water discharge valve 71 for discharging wash water is provided at the bottom of outer tub 72 and is connected to a drain channel 73. An overflow channel 74 is attached fixed to the outer wall surface of outer tub 72. The upper end of the overflow channel 74 is coupled with an overflow inlet 75 provided at the inner wall surface of the outer tub 72, while the lower end is connected to the drain channel 73 at a point in the down stream of the water discharge valve 71. The overflow channel 74 discharges redundant wash water exceeding a certain predetermined highest level (the level of overflow inlet 75) through the drain channel 73. A trap 76 is provided in the drain channel 73 after the overflow channel 74 is merged, the trap having a shape for retaining a certain amount of discharged water. The water kept in the trap 76 prevents the hot air from escaping during the drying process. An expandable connection duct 77 connects the water discharge channel at a place above the level of water discharge valve 71 to the heat exchanger 31. After the heat exchanger 31, the hot air supply channel 70 containing heater 25 and drying air blower 26, the flexible and expandable tube 69, and the gushing mouth 68 follow in the channel. The hot air blows out towards the bottom center of the inner tub 13. The heater 25 and the drying air blower 26 are disposed at a level higher than the overflow inlet 75. The other structures remain the same as those of the embodiment 12 above. The same symbols are provided to represent these portions, the description of which is not repeated here.

The operations under the above structure are described in the following. In the washing process, the wash load 35 and detergent is thrown into the inner tub 13 through the freely openable lid 66, water is supplied from a water supply tap into the inner tub 13 up to a predetermined level, and then the pulsator 16 is put into operation. During washing, the wash water exceeding the certain predetermined level, caused by too much volume of the wash load 35 or too high water level, is discharged from the overflow inlet 75 provided in the outer tub 72; going through the overflow channel 74, the drain channel 73 and the trap 76. Meanwhile, the heat exchanger 31 is also filled with water coming through the connection duct 77 up to a level identical to that in the outer tub 72. After the washing process is over, a rinsing process proceeds in a similar way.

Then operation proceeds to a spin-drying process. The water in the inner tub 13 is discharged through the unclosed water discharge valve 71, and then the inner tub 13 is rotated at a high speed in an ordinary manner for spin-drying. Then a drying process follows.

In the drying process, the water discharge valve 71 is closed. Pulsator 16 is rotated quickly in the forward and reverse directions in order to peel off the wash load 35 stuck to the inner wall of inner tub 13 because of a centrifugal force exerted during the spin-drying process. Hot air heated by the heater 25 is blown by the drying air blower 26 to be delivered into the inner tub 13 through the gushing mouth 68. The hot air heats the wash load 35 and evaporates the humidity contained in the wash load 3 5. Then the hot air proceeds through the holes in the side wall of inner tub 13, the gap between fluid balancer 15 and separation board 65, the gap between pulsator 16 and inner tub 13, etc. eventually arriving at the bottom part of outer tub 72, and then goes to the heat exchanger 31 guided by the connection duct 77. The humid hot air, after having evaporated the humidity of the wash load 35, is cooled and dehydrated at the heat exchanger 31, and then goes to the drying air blower 26 again. The drying process proceeds along with the circulation and dehydration of hot air. The dehydration water generated as a result of heat exchange conducted in the heat exchanger 31 is gradually accumulated on the water discharge valve 71. Therefore, the water discharge valve 71 is opened for several seconds at a certain interval to discharge the dehydration water, so that it does not block the hot air circulation channel. In the meantime, the pulsator 16 repeats the forward and reverse rotations to haul up and agitate the wash load 35 in order to help dry up the wash load. The water discharge valve 71 may be kept open during the drying process. In this case, the trap 76 prevents the escape of the hot air outside. However, the overflow channel 74 may serve as a detour for the hot air and the drying performance might deteriorate to a certain extent.

The drying air blower 26 and the heater 25 belong to the electric component. If the water invades the terminal, wiring or inner circuit of these components, there will be a risk of breakage in the components, or the leakage/short-circuiting of electricity. However, in the present embodiment, there is no such a danger and the safety is assured, because the drying air blower 26 and the heater 25 are disposed at a level higher than that of the overflow inlet 75 and the water does not exceed the level. Hence, the water level never reaches the drying air blower 26 and the heater 25 in the washing and the rinsing processes.

The trap 76 disposed in the drain channel 73 at a place after merging with the overflow channel 74 functions, besides the draining function, to prevent the escaping of hot air outside through the overflow channel 74 or the unclosed water discharge valve 71 during the drying process. Furthermore, because the heat exchanger 31 coupled with the hot air supply channel 70 is connected to the water discharge channel at a point above the water discharge valve 71 with the expandable connection duct 77, a hot air circulation channel has been formed between the cabinet (stationary end) 20 and the outer tub (vibrating end) 72 in a space-saving configuration using only one water discharge valve 71.

Although the flexible and expandable tube 69 and the hot air supply channel 70, etc. in the present embodiment have been structured in the same manner as in the embodiment 12, these items may of course be structured instead in the same manner as in the embodiments 1 through 11 described earlier.

Figure 18:
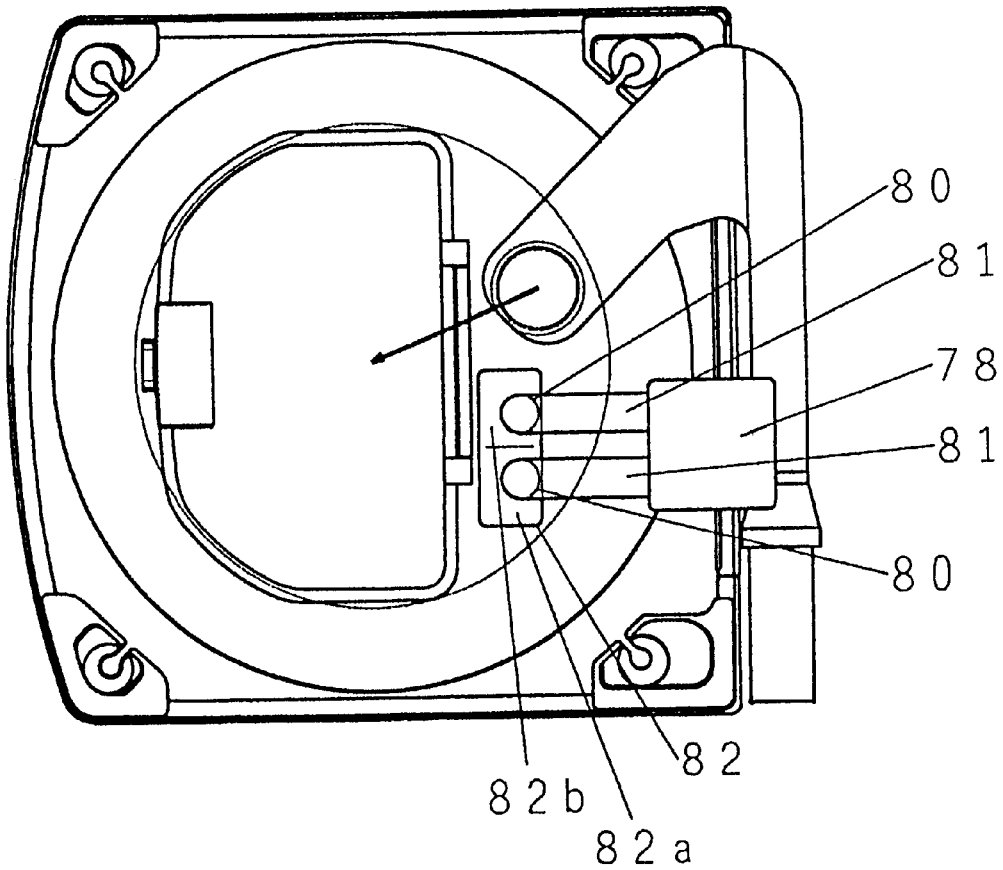
FIG. 18 is a partially cut-off plan view of the above washer-dryer.
Figure 19:
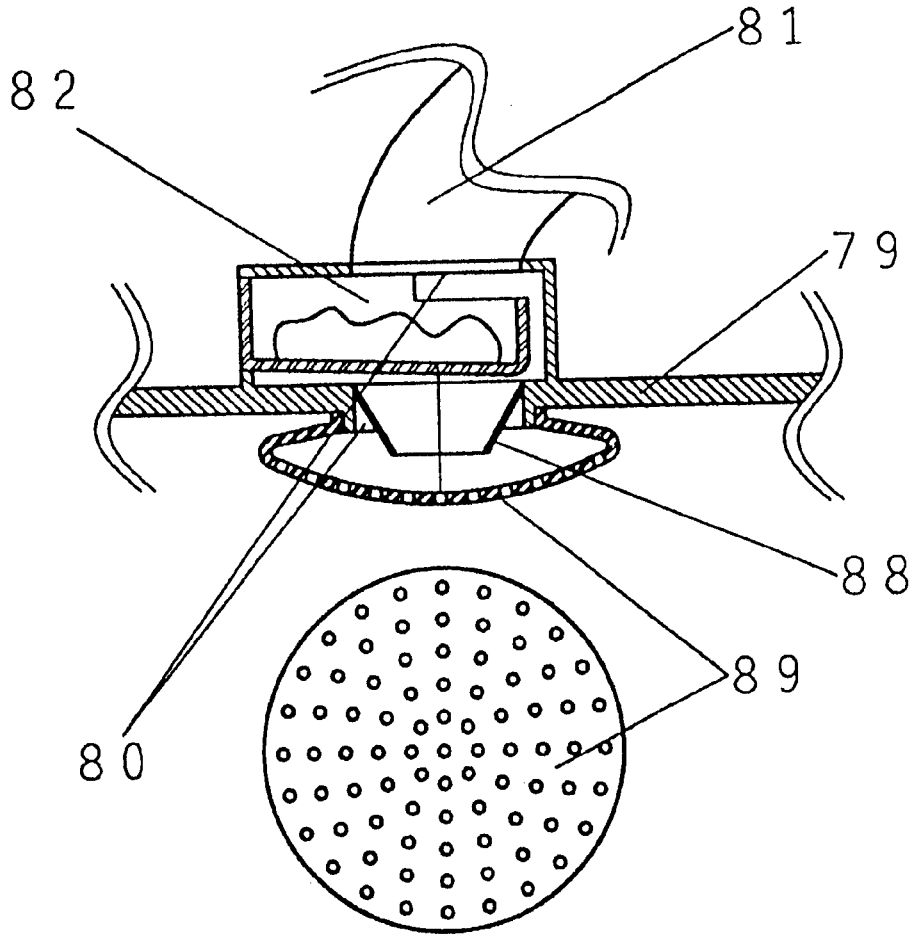
FIG. 19 is a cross sectional view showing a key portion of the above washer-dryer.
Figure 20:
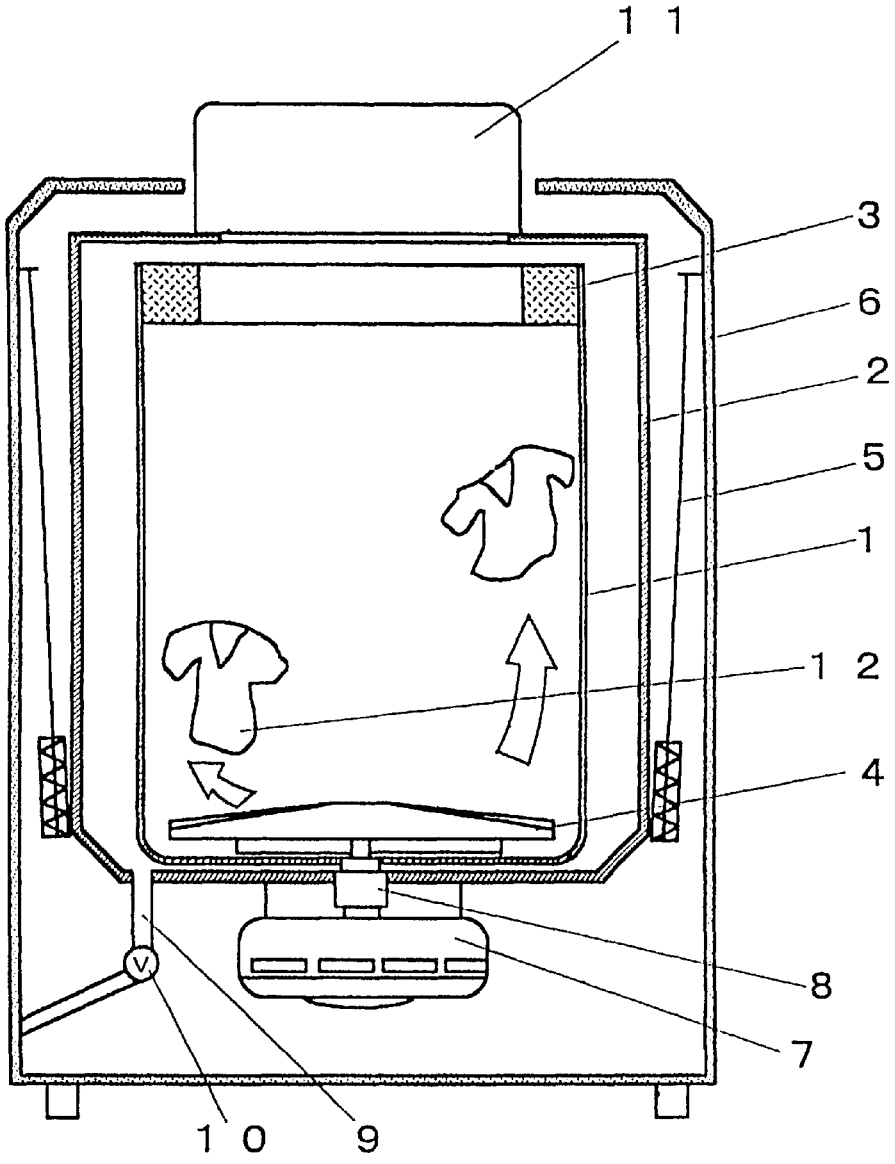
FIG. 20 is a vertical cross sectional view of a conventional washer-dryer.

A fourteenth exemplary embodiment of the present invention is described in the following with reference to the drawings FIG. 17 through FIG. 19.

Figure 17:
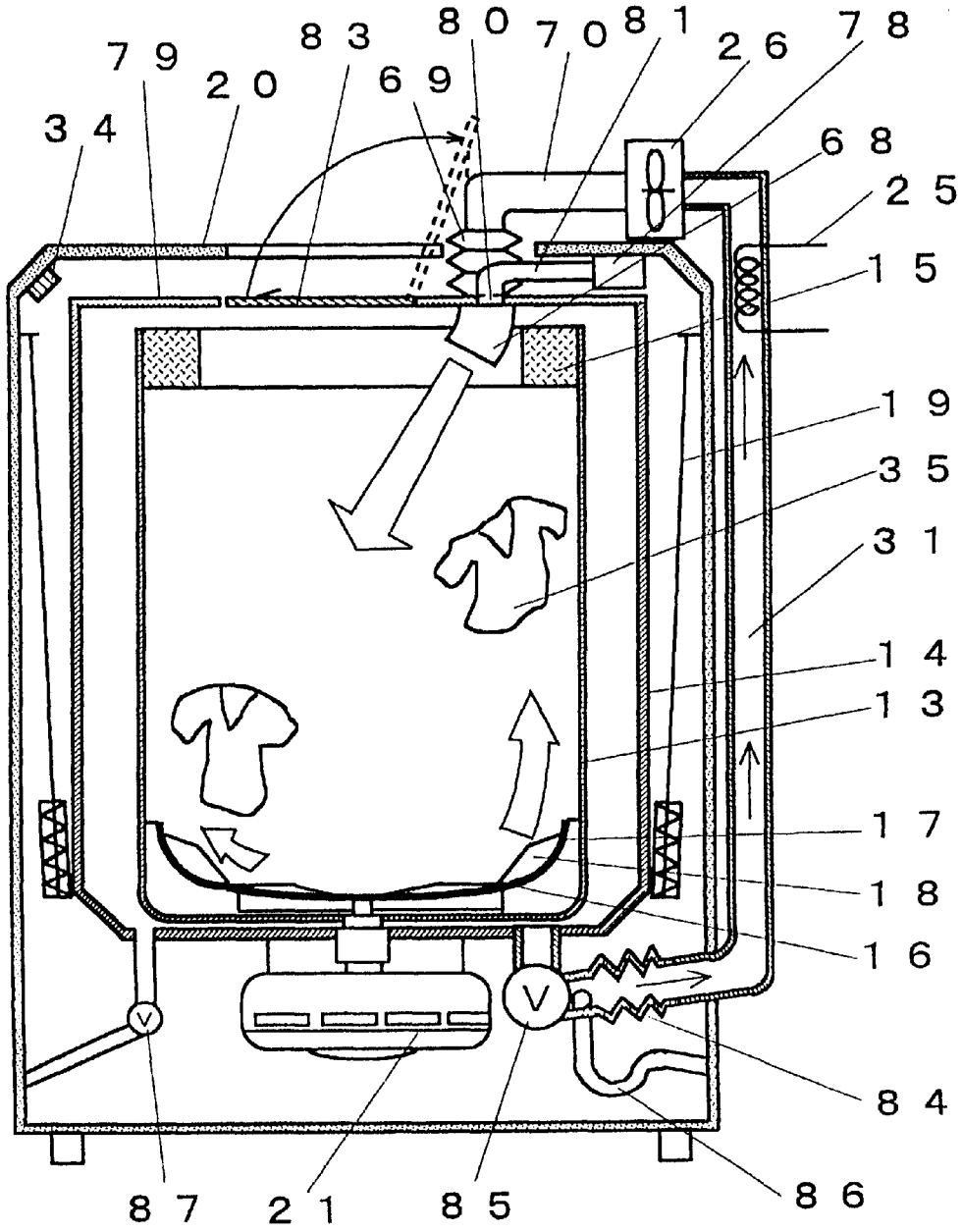
FIG. 17 is a vertical cross sectional view of a washer-dryer in accordance with a fourteenth exemplary embodiment of the present invention.

As shown in FIG. 17, a water supply valve 78 is fixed to the cabinet 20 for supplying tap water into the inner tub 13. The water is supplied to inner tub 13 through a faucet 80 provided in the separation board 79. An expandable water supply duct 81 connects the water supply valve 78 and the faucet 80 to form a water supply channel. The water supply channel comprises a dual system as shown in FIG. 18, corresponding respectively to a detergent dispensing section 82*a* and a softening agent dispensing section 82*b* of a detergent dispenser 82 provided at the faucet 80.

A hot air supply channel 70 comprising a heater 25 for heating the air and a drying air blower 26 for delivering the hot air into the inner tub 13 is fixed to the cabinet 20. The hot air supply channel 70 is connected to a gushing mouth 68 via the flexible and expandable tube 69 of bellows shape. The separation board 79 is fixed covering the top part of an outer tub 14, for preventing the hot air from escaping upward. The separation board 79 is provided with a lid 83, which is freely openable to take in and out a wash load 35. The faucet 80 and the gushing mouth 68 are also provided in the separation board 79 at an area far from the operator, and the water supply duct 81 is structured in a compact configuration so as to afford a largest possible area for the freely openable lid 83.

At the upstream end of the hot air supply channel 70 is the heat exchanger 31 for cooling and dehydrating. The heat exchanger 31 is connected to the bottom part of outer tub 14 via an expandable connection duct 84 and an air channel valve 85 for opening/closing the air flow channel. A trapped drain channel 86, which retains water in the route, is branching out from the connection duct 84 at the lowest point, discharges the dehydration water from heat exchanger 31, and prevents the air from escaping. A water discharge valve 87 is opened for discharging washing water and at the spin-drying operation.

Now in the following, detailed structure of the faucet 80 and the vicinity is described referring to FIG. 19. On the upper surface (or the reverse surface) of the separation board 79, a detergent dispenser 82 is provided in the form of a drawer. Detergent or softening agent kept in the detergent dispenser 82 is delivered mixed with water to the inside of inner tub 13. A non-return valve 88 is a valve of elastic film that easily opens in only one direction. When a pressure of water comes from above, it opens to a funnel shape, and the film shrinks to close as soon as the water pressure is lifted. A shower nozzle 89 is provided at the tip end of the faucet 80, for showering the water into the inner tub 13 through a number of small holes. The shower nozzle 89 is detachable and nozzles of other configurations are prepared to meet different types of needs for the water supply. The other structures remain the same as those of the above embodiment 12. The same symbols are used to represent these portions and the description is not repeated here.

The operation under the above structure is described in the following. In a washing process, the openable lid 83 is opened and a wash load 35 is thrown into the inner tub 13, and detergent and softening agent, if necessary, are put into the detergent dispenser 82, and then operation is started. With the water discharge valve 87 and the air channel valve 85 kept closed, water is supplied from the water supply valve 78 to the detergent dispensing section 82*a*. The water dissolves and includes the detergent to become a washing water, which is delivered through the non-return valve 88 and the shower nozzle 89 into the inner tub 13 up to a certain predetermined level. A clutch built in a motor 21 conveys the rotating force of the motor 21 to a washing shaft in order to rotate the pulsator 16. The rotating pulsator 16 agitates the wash load 35.

If in the washing process the level of water is raised very high due to too much volume of the wash load, foam of the detergent might come close to the faucet 80 and enter into the water supply duct 81, in the worst case it might ascend to the tap water facility. However, the non-return valve 88 prevents this from occurring. The outer tub 14 is provided with an overflow inlet (not shown) for preventing the water from overflowing. Even if water overflows despite the overflow inlet, the non-return valve 88 prevents the worst case from happening.

In the final rinsing course, the water supply valve 78 opens at the softening agent dispensing section 82*b*, and the softening agent is supplied to the inner tub 13 accompanied by the water. After the washing and rinsing processes are over, a spin-drying process starts, where the water discharge valve 87 is opened to discharge the water in the inner tub 13, and the rotating force of motor 21 is conveyed via a clutch built in the motor 21 to the inner tub 13. The inner tub 13 is rotated together with the pulsator 16 at a high speed, and the wash load 35 is spin-dried by a centrifugal force.

In the drying process, the pulsator 16 is rotated quickly in the forward and reverse directions to peel off the wash load 35 stuck to the inner wall of inner tub 13 because of the centrifugal force exerted during the spin-drying process. The water discharge valve 87 is closed and the air channel valve 85 is opened. The wind created by the drying air blower 26 is heated while passing through the heater 25 to become a hot air, which is delivered via the flexible and expandable tube 69 into the inner tub 13 by way of the gushing mouth 68. The hot air can not escape upward because of the separation board 79. The hot air heats the wash load 35 and evaporates the humidity contained in the wash load 35, and proceeds through the holes in the side wall of inner tub 13 and the gap between fluid balancer 15 and separation board 79, reaching the heat exchanger 31 guided by the connection duct 84 attached to the bottom part of the outer tub 14. The humid hot air is cooled and dehydrated at the heat exchanger 31, and then goes again to the drying air blower 26. The drying process proceeds along with the circulation and dehydration of hot air. The dehydration water is discharged outside through the trapped drain channel 86. In the meantime, the pulsator 16 repeats the forward and reverse rotations to haul up and agitate the wash load 35 in order to help drying.

In a washer-dryer of the present embodiment, a separation board 79 is provided, also a water supply duct 81 is provided which couples a water supply valve 78 with a faucet 80 disposed on the separation board 79. Therefore, the water can be supplied through the water supply duct 81 and the hot air is prevented from escaping during a drying process. The washer-dryer exhibits a high drying performance, and does not bring about an increased humidity in the room air.

Furthermore, as the faucet 80 is disposed on the separation board 79 at a place far from the operator the water supply channel can be formed in a compact configuration. As a result, a sufficiently large area can be secured for throwing in and removing a wash load 35. Thus the ease of putting in and removing a wash load 35 is improved.

The non-return valve 88 provided at the faucet 80 prevents the washing foam and water from invading the water supply duct 81 and the tap water facility. The safety is thus improved.

Although the flexible and expandable tube 69, the hot air supply channel 70, etc. of the present embodiment have been structured in the same manner as in the embodiment 12 above, these items may of course be structured instead in the same way as those of the embodiment 1 through 11.

Although the non-return valve 88 has been structured using an elastic film material in the present embodiment, it is not limited to such a structure. It may be structured with a sort of flap that opens by the force of a fluid only in downward direction, or an electrical control valve may be used.

Although the non-return valve 88 has been disposed at a place lower than the detergent dispenser 82, it may rather be desirable to dispose it at a place higher than the detergent dispenser 82, because foam can be generated within the detergent dispenser 82.

Although the shower nozzle 89 has been structured so as to deliver water through a number of small holes into the inner tub 13 in the form of a shower, it is not limited to such a structure. The water may be delivered through a slit nozzle or a sprinkler. Other modes of supplying the water include a supply with foam, a high-speed jet, etc.

What is claimed is:

1. A washer-dryer comprising:

an inner tub for receiving a wash load, said inner tub having an approximately cylindrical shape and being rotatable around a substantially vertical axis;

an outer tub housing said inner tub;

a separation board covering a top part of said outer tub, said separation board being operable to prevent air from escaping;

a faucet being disposed in said separation board;

a water supply valve being operable to supply water into said inner tub;

a water supply duct coupling said faucet to said water supply valve;

agitation means for agitating the wash load, said agitation means being freely rotatable and being provided inside of said inner tub, wherein said agitation means comprises a pulsator having a sloped surface around an outer circumference of said pulsator and a plurality of ribs extending in radial directions across said sloped surface as far as an outer edge of said pulsator;

a motor being operable to rotate said inner tub or said agitation means;

a connection duct being operable to receive humid hot air from a bottom part of said outer tub;

a heat exchanger being operable to cool and dehydrate the humid hot air;

a hot air supply channel operable to supply air into said inner tub;

heating means for heating air supplied from said heat exchanger;

a drying air blower operable to deliver the air supplied from said heat exchanger into said inner tub via said hot air supply channel;

control means for controlling each respective process of washing, rinsing, spin-drying and drying, by exerting control on operations of at least said motor, said heating means, said drying air blower.

2. A washer-dryer of claim 1, wherein said faucet is disposed in said separation board at a location away from an operator.

3. A washer-dryer of claim 2, further comprising a non-return valve provided at said faucet.

4. A washer-dryer of claim 3, wherein said non-return valve comprises an elastic film.

5. A washer-dryer of claim 1, wherein said sloped surface around said outer circumference of said pulsator is concave in a direction away from said bottom part of said outer tub.

6. A washer-dryer of claim 1, further comprising a detergent dispenser provided at said faucet.

7. A washer-dryer of claim 6, wherein said detergent dispenser comprises a detergent dispensing section operable to dispense detergent into said inner tub and a softening agent dispensing section operable to dispense a softening agent into said inner tub.

8. A washer-dryer comprising:

an inner tub for receiving a wash load, said inner tub having an approximately cylindrical shape and being rotatable around a substantially vertical axis;

an outer tub housing said inner tub;

a separation board covering a top part of said outer tub, said separation board being operable to prevent air from escaping;

a faucet being disposed in said separation board;

a water supply valve being operable to supply water into said inner tub;

a water supply duct coupling said faucet to said water supply valve;

a pulsator being operable to agitate the wash load, said pulsator being freely rotatable and being provided inside of said inner tub, wherein said pulsator having a sloped surface around an outer circumference of said pulsator and a plurality of ribs extending in radial directions across said sloped surface as far as an outer edge of said pulsator;

a motor being operable to rotate said inner tub or said pulsator;

a connection duct being operable to receive humid hot air from a bottom part of said outer tub;

a heat exchanger being operable to cool and dehydrate the humid hot air;

a hot air supply channel operable to supply air into said inner tub;

a heater operable to heat air supplied from said heat exchanger;

a drying air blower operable to deliver the air supplied from said heat exchanger into said inner tub via said hot air supply channel;

a controller operable to control each respective process of washing, rinsing, spin-drying and drying, by exerting control on operations of at least said motor, said heater, said drying air blower.

9. A washer-dryer of claim 8, wherein said faucet is disposed in said separation board at a location away from an operator.

10. A washer-dryer of claim 9, further comprising a non-return valve provided at said faucet.

11. A washer-dryer of claim 10, wherein said non-return valve comprises an elastic film.

12. A washer-dryer of claim 8, wherein said sloped surface around said outer circumference of said pulsator is concave in a direction away from said bottom part of said outer tub.

13. A washer-dryer of claim 8, further comprising a detergent dispenser provided at said faucet.

14. A washer-dryer of claim 13, wherein said detergent dispenser comprises a detergent dispensing section operable to dispense detergent into said inner tub and a softening agent dispensing section operable to dispense a softening agent into said inner tub.

* * * * *